US010738596B2

(12) United States Patent
Hay

(10) Patent No.: US 10,738,596 B2
(45) Date of Patent: Aug. 11, 2020

(54) DATA TRANSMISSION IN DRILLING OPERATION ENVIRONMENTS

(71) Applicant: HALLIBURTON ENERGY SERVICES, INC., Houston, TX (US)

(72) Inventor: Richard Thomas Hay, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/503,852

(22) Filed: Jul. 5, 2019

(65) Prior Publication Data

US 2019/0330977 A1 Oct. 31, 2019

Related U.S. Application Data

(63) Continuation of application No. 15/708,457, filed on Sep. 19, 2017, now abandoned, which is a continuation of application No. 13/991,590, filed as application No. PCT/US2011/064660 on Dec. 13, 2011, now abandoned.

(51) Int. Cl.

| | |
|---|---|
| ***E21B 47/12*** | (2012.01) |
| ***E21B 17/00*** | (2006.01) |
| ***E21B 17/02*** | (2006.01) |

(52) U.S. Cl.

CPC ..... *E21B 47/122* (2013.01); *E21B 17/003* (2013.01); *E21B 17/028* (2013.01); *E21B 47/12* (2013.01)

(58) Field of Classification Search

CPC ..... E21B 17/003; E21B 17/02; E21B 17/023; E21B 17/028; E21B 47/12; E21B 47/121; E21B 47/122

See application file for complete search history.

(56) References Cited

U.S. PATENT DOCUMENTS

| | | | | |
|---|---|---|---|---|
| 2,823,330 A | | 2/1958 | Landrey | |
| 3,253,245 A | | 5/1966 | Brandt | |
| 3,406,126 A | | 10/1968 | Litant | |
| 4,220,381 A | * | 9/1980 | van der Graaf ..... | E21B 17/028 340/853.7 |

(Continued)

FOREIGN PATENT DOCUMENTS

WO WO 2012/082748 A2 6/2012

OTHER PUBLICATIONS

Baru, R. L., et al., "Rheological and Electrical Properties of Oxidized Carbon Black Suspensions in Vaseline Oil under Shear and Vibration", Colloid Journal, 65(4), (Jul. 2003), 403-408.

Conductivity and Resistivity Values for Iron & Alloys, [online]. Retrieved from the Internet: http://www.ndt-ed.org/GeneralResources/MaterialProperties/ET/Conductivity_Iron.pdf, (2010), 6 pgs.

(Continued)

*Primary Examiner* — Franklin D Balseca

(74) *Attorney, Agent, or Firm* — Haynes and Boone, LLP

(57) ABSTRACT

Apparatus, systems, and methods may operate to transmit a data signal along a transmission line extending lengthwise along a drill string, the transmission line comprising an outer conductive path provided by a tubular wall of a drill pipe that extends along the drill string; and an internal conductive path extending along an interior passage that is bounded by a radially inner cylindrical surface of the drill pipe and along which drilling fluid is conveyed, the inner conductive path being substantially insulated from the outer conductive path. Additional apparatus, systems, and methods are described.

24 Claims, 10 Drawing Sheets

(56) References Cited

U.S. PATENT DOCUMENTS

| | | | | |
|---|---|---|---|---|
| 4,228,194 | A | 10/1980 | Meeder | |
| 4,228,481 | A | 10/1980 | DiNicola et al. | |
| 4,637,418 | A | 1/1987 | Karl | |
| 4,953,636 | A | 9/1990 | Mohn | |
| 5,403,873 | A * | 4/1995 | Nakamura | C08K 5/0016 252/500 |
| 6,006,831 | A * | 12/1999 | Schlemmer | C09K 8/32 166/250.01 |
| 6,114,857 | A | 9/2000 | Kohl | |
| 6,655,464 | B2 | 12/2003 | Chau et al. | |
| 6,712,150 | B1 | 3/2004 | Misselbrook et al. | |
| 6,763,887 | B2 | 7/2004 | Boyadjieff | |
| 6,770,603 | B1 | 8/2004 | Sawdon et al. | |
| 7,156,676 | B2 | 1/2007 | Reynolds | |
| 7,363,160 | B2 | 4/2008 | Seleznez et al. | |
| 7,605,715 | B2 * | 10/2009 | Clark | E21B 17/028 174/47 |
| 7,694,402 | B2 | 4/2010 | Zifferer et al. | |
| 8,242,928 | B2 | 8/2012 | Prammer | |
| 8,567,657 | B2 * | 10/2013 | Andreychuk | E21B 17/206 228/155 |
| 2002/0113716 | A1 * | 8/2002 | Aiello | E21B 17/003 340/853.1 |
| 2006/0151179 | A1 * | 7/2006 | Boyadjieff | E21B 17/003 166/380 |
| 2008/0074825 | A1 | 3/2008 | Togashi | |
| 2010/0264646 | A1 | 10/2010 | Follini | |
| 2011/0024103 | A1 * | 2/2011 | Storm, Jr. | E21B 17/206 166/65.1 |

OTHER PUBLICATIONS

Dielectric Constant Reference Guide, [online]. [archived on Apr. 27, 2009]. Retrieved from the Internet: http://www.clippercontrols.com/info/dielectric_constants.html, 60 pgs.

Drill Pipe Specifications, [online]. © 2009 Sunnda Corporation. [archived on Dec. 12, 2009]. Retrieved from the Internet: https://web.archive.org/web/20091212095612/http://www.drill-pipes.com/drill-pipe-specifications.php, (2009), 3 pgs.

Inductance, From Wikipedia®, the free encylopedia. [online]. [archived on Feb. 11, 2010]. Retrieved from the Internet: http://en.wikipedia.org/wiki/Inductance, (last modified Jan. 22, 2010), 10 pgs.

International Application Serial No. PCT/US2011/064660, International Preliminary Report on Patentability dated Mar. 6, 2014, 10 pgs.

International Application Serial No. PCT/US2011/064660, International Preliminary Report on Patentability dated Apr. 5, 2013, 18 pgs.

International Application Serial No. PCT/US2011/064660, International Search Report dated Apr. 10, 2012, 2 pgs.

International Application Serial No. PCT/US2011/064660, Response filed Sep. 28, 2012 to Written Opinion dated Apr. 10, 2012, 11 pgs.

International Application Serial No. PCT/US2011/064660, Written Opinion dated Apr. 10, 2012, 8 pgs.

Relative static permittivity, Wikipedia, the free encyclopedia. [online]. [archived on Jul. 20, 2009]. Retrieved from the Internet: http://web.archive.org/web/20090720014545/http://en.wikipedia.org/wiki/Relative_static_permittivity, (2009), 3 pgs.

Serway, Raymond A., et al., In: Physics for Scientists and Engineers, Fifth Edition, Thomson Learning, Inc., (2000), p. 808.

* cited by examiner

DATA TRANSMISSION IN DRILLING OPERATION ENVIRONMENTS

CROSS-REFERENCE TO RELATED APPLICATIONS

The present application is a Continuation of U.S. patent application Ser. No. 15/708,457 filed Sep. 19, 2017, which is a Continuation of U.S. patent application Ser. No. 13/991,590 filed Jun. 26, 2013, which is a National Stage Application of International Application No. PCT/US2011/064660, filed on Dec. 13, 2011, which claims priority to U.S. Provisional Patent Application No. 61/422,858, filed on Dec. 14, 2010. The disclosure of each of which is incorporated herein by reference in its entirety.

BACKGROUND

Electromagnetic (EM) telemetry in drilling operation environments uses a drill pipe and a formation in which a well bore is drilled as two conductive paths for propagating an electromagnetic field. Owing in part to high conductivity of the formation and the drill pipe, leakage currents and the skin effect result in a usable bandwidth that is in the range of less than 50 Hz; typically 5-25 Hz.

Some disadvantages of such EM telemetry includes shunt losses back to the drill pipe from the formation, series resistance through earth formations, and field dispersion that results from lateral spreading out of conduction in the formation. These factors negatively affect signal strength and limit the distance of effective signal propagation.

BRIEF DESCRIPTION OF THE DRAWINGS

Some embodiments are illustrated by way of example and not limitation in the figures of the accompanying drawings. In the drawings, like reference numerals indicate like elements. In some instances, a single reference numeral may be used in different drawings to indicate two or more distinct, non-identical embodiments or variations of a particular element or component in the drawings.

DETAILED DESCRIPTION

Figure 1:
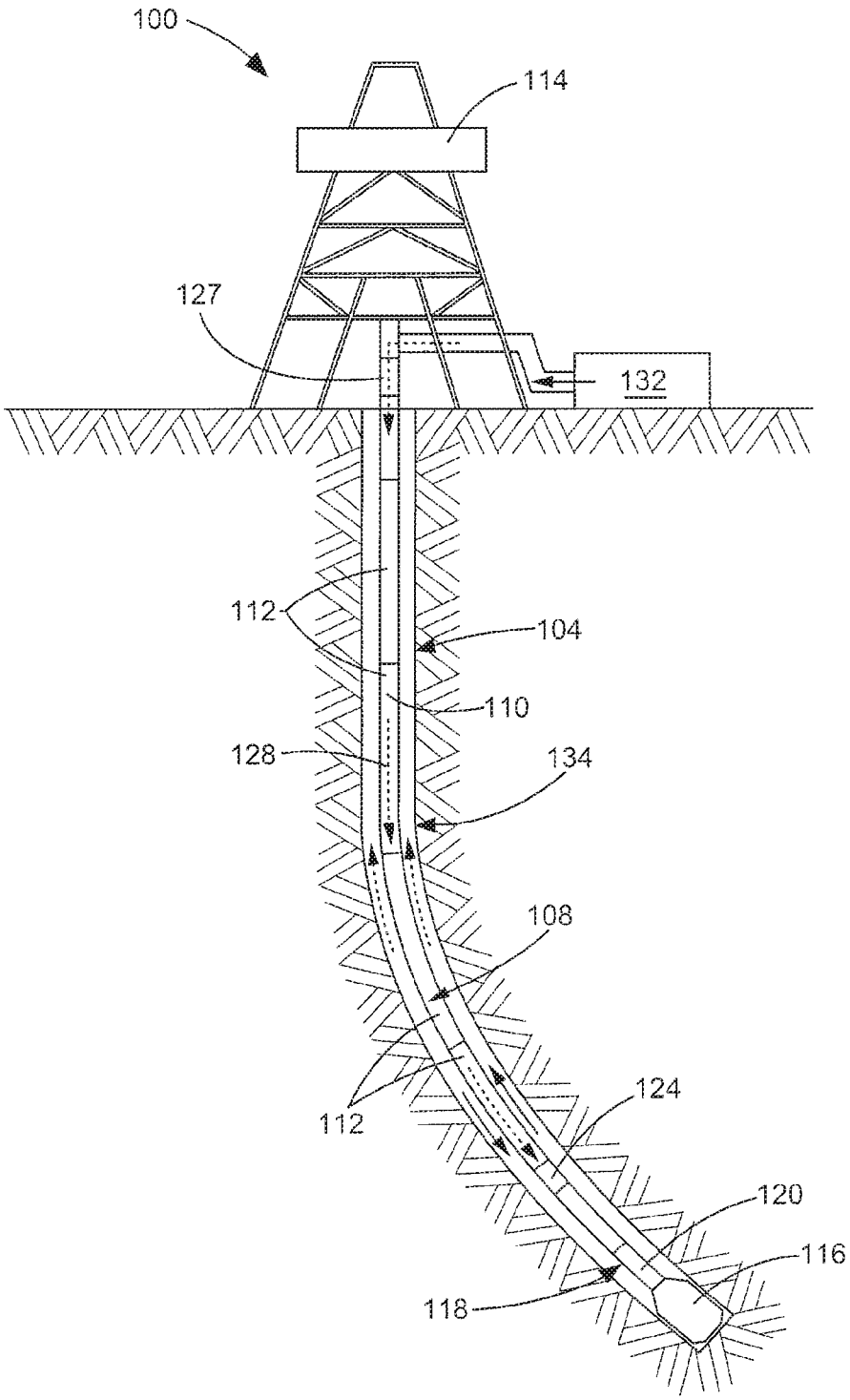
FIG. 1 depicts a schematic diagram of a drilling installation that comprises a drill string including a data transmission system, in accordance with an example embodiment.

The following detailed description refers to the accompanying drawings that depict various details of examples selected to show how the present invention may be practiced. The discussion addresses various examples of the inventive subject matter at least partially in reference to these drawings, and describes the depicted embodiments in sufficient detail to enable those skilled in the art to practice the invention. Many other embodiments may be utilized for practicing the inventive subject matter other than the illustrative examples discussed herein, and structural and operational changes in addition to the alternatives specifically discussed herein may be made without departing from the scope of the inventive subject matter.

In this description, references to "one embodiment" or "an embodiment," or to "one example" or "an example" are not intended necessarily to refer to the same embodiment or example; however, neither are such embodiments mutually exclusive, unless so stated or as will be readily apparent to those of ordinary skill in the art having the benefit of this disclosure. Thus, a variety of combinations and/or integrations of the embodiments and examples described herein may be included, as well as further embodiments and examples as defined within the scope of all claims based on this disclosure, as well as all legal equivalents of such claims.

In accordance with one embodiment, a system is provided that comprises a drill string extending along at least part of a wellbore, the drill string comprising drill pipe having a tubular wall that is of electrically conductive material and that defines an interior passage extending along the drill string to convey drilling fluid. The drill string provides a signal transmission line that comprises an outer conductive path formed by the tubular wall of the drill pipe, and an internal conductive path extending along the interior passage, the internal conductive path being substantially electrically insulated from the outer conductive path. A transmitter is coupled to the transmission line to transmit a data signal along the transmission line.

The drill pipe may thus have an insulation layer that provides a dielectric insulator on its radially inner cylindrical surface, to isolate the electrically conductive material of the drill pipe's tubular wall from the internal conductive path provided in the interior passage. Such electrical insulation between the internal conductive path and the outer conductive path allows the two paths of the transmission line to be connected together in series by the transmitter, so that application or induction of an alternating electrical current in the resulting circuit causes propagation along the transmission line of associated voltage differences (and therefore of a data transmission signal) over the conductive paths. The transmission line thus provides a hybrid signal propagation path.

As used herein, the term "interior passage" of the drill pipe or the drill string means a bore extending lengthwise through the drill pipe, so that the radially outer boundary of the interior passage is defined by a radially inner cylindrical surface of the drill pipe's tubular wall of conductive material, typically metal. The interior passage provides a fluid conduit that may, as used herein, have a smaller inner diameter than the interior passage of the drill pipe due to the provision of elements such as an insulating layer, a dielectric insulator, a conductor segment, a conductive coating, other structural conductor elements, a protection layer, a liner, or the like on the radially cylindrical inner surface of the drill pipe. Such elements are understood to be located in the interior passage of the drill pipe and to be distinct from the drill pipe's tubular wall. Such elements are further not necessarily located in the fluid conduit, even though some of these elements may be exposed to drilling fluid in the fluid conduit.

At least part of the internal conductive path may comprise drilling fluid in the interior passage. In some embodiments, the internal conductive path may comprise no structural conductors or structural conductor elements attached to the interior cylindrical surface of the drill pipe, so that the internal conductive path is primarily provided by drilling fluid in the drill string. With a structural conductor or structural conductor element is meant a component that is of solid conductive material, as opposed to a fluid or liquid material. Such structural conductors may include coated layers, metal liners, wires, or the like.

The internal conductive path may thus comprise a structural conductor that extends lengthwise along the drill string and is attached to the tubular wall of the drill pipe such that the structural conductor is located at or adjacent a radially outer boundary of the interior passage, when the drill pipe is viewed in cross-section. As used herein, attachment of a particular element to the tubular wall of the drill pipe, or to the cylindrical inner surface of the tubular wall, means that the element has a fixed location relative to the tubular wall and is located at or adjacent a radially outer edge of the fluid conduit, but it is not is not meant to be limited to a connection having direct contact between the element and the conductive material of the tubular wall. Instead, attachment of a particular element to the tubular wall of the drill pipe may include indirect attachment to another element fast with the tubular wall. For example, a conductive layer on a radially inner surface of a dielectric insulator that is, in turn, directly attached to the radially inner metal surface of the drill pipe, is considered to be attached to the tubular wall of the drill pipe.

The drill pipe may be segmented, comprising a plurality of pipe sections that are connected together end-to-end in series, each pipe section including a conductor segment that is attached to the tubular wall of the pipe section and extends along a substantial portion of the length of the pipe section. The structural conductor of the inner conductive path may in such embodiments be a segmented structural conductor that includes the conductor segments of the plurality of pipe sections arranged end-to-end in series. Note that the conductor segment is electrically insulated from the tubular wall of the pipe section even though it is structurally connected to the inner cylindrical surface of the tubular wall, so that it is fast with the tubular wall and protrudes into the interior passage by an amount approximately equal to its thickness. In some embodiments, attachment of the conductor segment to the tubular wall may be by inclusion of the conductor segment in a nonconductive cylindrical liner that abuts against the inner cylindrical surface of the tubular wall. In other embodiments, the conductor segment may be provided on an insulating coating or layer that covers the inner cylindrical surface of the tubular wall's conductive material. Note further that neighboring conductor segments may be circumferentially misaligned, while still effectively being connected in series via the drilling fluid.

The segmented structural conductor may have gaps at respective pipe section joints, at least part of each conductor segment being exposed to drilling fluid in the interior passage at the respective gaps, to propagate electrical current between adjacent conductor segments through the drilling fluid. The internal conductive path may in such instances be provided by a combination of the conductor segments and the drilling fluid, relatively long conductor segments being arranged in series with relatively short hops through the drilling fluid between them.

A protection layer may partially cover each conductor segment, to protect the covered part of the conductor segment from exposure to drilling fluid. Each conductor segment may thus comprise exposed electrodes at opposite ends of the pipe section to facilitate propagation of current between adjacent electrodes through the drilling fluid. The protection layer may be of an electrically insulating material to provide electrical insulation between the drilling fluid and the covered part of the conductor segment, to promote conduction between the conductor segment and the drilling fluid only at the electrodes.

One example embodiment of a method and system for data transmission in a drilling operation environment is illustrated with reference to FIGS. 1-5. FIG. 1 shows a schematic view of a drilling installation 100 that includes a subterranean wellbore 104 in which a drill string 108 is located. The drill string 108 includes an elongated drill pipe 110 that it extends lengthwise along the wellbore 104 and provides the structure of the drill string 108. The drill pipe 110 in the current example embodiment is segmented, comprising a series of pipe sections 112 that are connected together end-to-end in series. Note that the drill pipe 110 may typically comprise a greater number of pipe sections 112 than is shown in the schematic view of FIG. 1, which is simplified for ease of explanation. The drill pipe 110 is suspended from a drilling platform 114 secured at a wellhead. A downhole assembly or bottom hole assembly (BHA) 118 at a bottom end of the drill string 108 includes a drill bit 116. A measurement and control assembly 120 is included in the drill string 108, which includes measurement instruments to measure borehole parameters, drilling performance, and the like.

The drill string 108 includes two transceiver subassemblies in the form of a downhole transceiver sub 124 adjacent to the bottom hole assembly 118 and an uphole transceiver sub 127 adjacent to the wellhead. In the current example embodiment, the uphole transceiver sub 127 is located above ground. The downhole transceiver sub 124 and the uphole transceiver sub 127 are configured to transmit and receive electromagnetic data signals between them along a transmission line having two conductive paths provided by the drill string 108, as is described in greater detail below with reference to FIGS. 2-5. The downhole transceiver sub 124 is communicatively coupled to the measurement and control assembly 120, to receive telemetry data from the measurement and control assembly 120 for transmission to the uphole transceiver sub 127, and to communicate control data that is received by the downhole transceiver sub 124 from the uphole transceiver sub 127 to the measurement and control unit 120.

Drilling fluid (e.g. drilling "mud," or other fluids that may be in the well), is circulated from a drilling fluid reservoir 132, for example a storage pit, at the earth's surface, and coupled to the wellhead by means of a pump (not shown) that forces the drilling fluid down a drilling fluid conduit provided along an interior passage 128 defined by a hollow interior of the drill pipe 110. The drilling fluid exits under high pressure through the drill bit 116 and thereafter occupies a borehole annulus 134 defined between a radially outer cylindrical surface of the drill pipe 110 and the cylindrical wall of the wellbore 104. The drilling fluid then carries cuttings from the bottom of the wellbore 104 to the wellhead, where the cuttings are removed and the drilling fluid may be returned to the drilling fluid reservoir 132.

Figure 2:
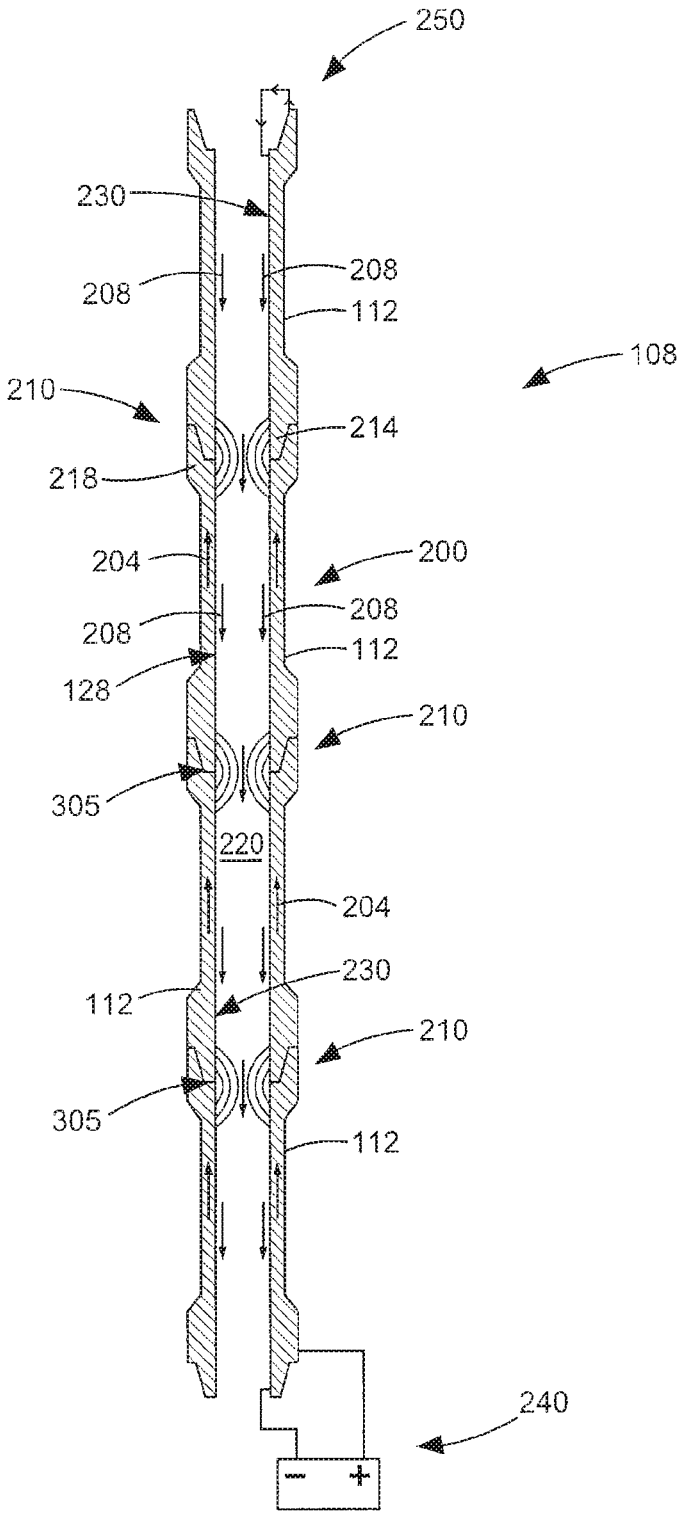
FIG. 2 depicts a schematic circuit of a transmission line provided by the drill string of FIG. 1, including a schematic cross-sectional view of drill pipe forming part of the drill string.
Figure 3:
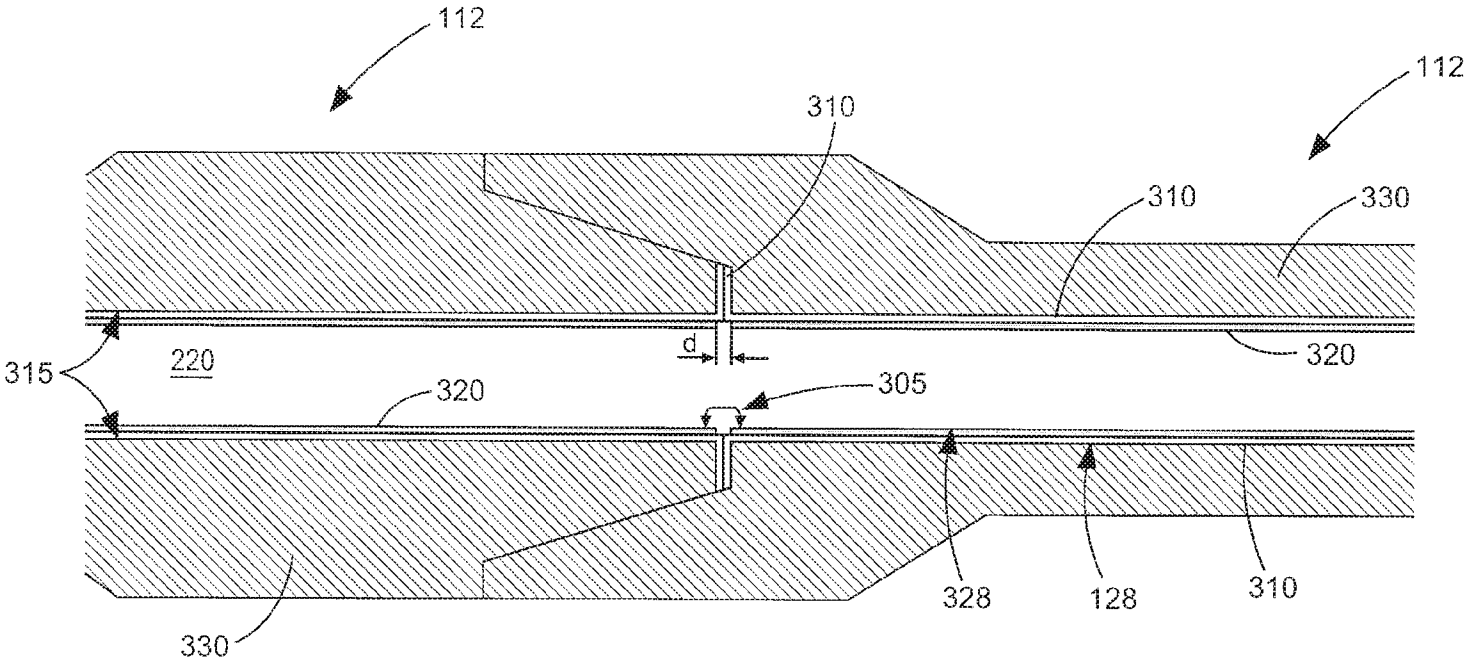
FIG. 3 depicts a schematic cross-sectional view, on an enlarged scale, of a pipe joint in an example drill pipe forming part of the drilling installation of FIG. 1.

FIG. 2 shows a schematic cross-sectional view of a part of the drill string 108, and provides a basic schematic circuit of a two-conductor transmission line 200 provided by the drill string 108 to allow data signal propagation along a lossy hybrid data signal path formed by the transmission line 200. FIG. 3 shows a cross-sectional view of one of a plurality of joints 210 of the drill string 108, on a magnified scale. Turning now to FIG. 2, the transmission line 200 comprises an outer conductive path (indicated by arrows 204 in FIG. 2) and an internal conductive path (indicated by arrows 208). The schematic diagram of FIG. 2 shows a current loop in one direction, indicated by arrows 204, 208. The outer conductive path 204 is provided by a substantially tubular wall of the drill pipe 110, which is of a conductive material such as steel or another ferrous alloy. Neighboring pipe sections 112 are connected together end-to-end at respective joints 210 by threaded pin-and-box connections in which a threaded pin 214 is screwed into engagement into a threaded socket provided by the box ends 218 of the neighboring pipe sections 112. The metal tubular walls of neighboring pipe sections 112 are thus in metal-to-metal contact, so that the composite tubular wall of the drill pipe 110 formed by the series of pipe sections 112 provides a more or less continuous outer electrically conductive path 204.

The internal conductive path 208 is provided, in the example embodiment of FIGS. 1-5, by a combination of drilling fluid 220 in the interior passage 128 of the drill string 108 and a segmented structural conductor 230. The structural conductor 230 is attached to the drill pipe 110 and extends lengthwise along the drill string 108, having a series of interruptions or gaps 305 (see FIG. 3) at respective joints 210 of the pipe sections 112. The pipe sections 112 provide respective conductor segments 320 (best seen in FIG. 3) that are attached to the tubular walls 330 (FIG. 3) of the pipe sections 112 and are arranged in series, together to form the segmented structural conductor 230 and being separated by respective electrical gaps 305 between adjacent conductor segments 320. Electrical current in the internal conductive path 208 propagates across the gaps 305 through the drilling fluid 220, as indicated by electrical field lines at the respective joints 210 in FIG. 2, a fluid conduit 328 provided in the interior passage 128 being filled with drilling fluid 220. The internal conductive path 208 is electrically isolated from the outer conductive path 204 by a dielectric insulator 310 in the form of an insulation layer (see FIG. 3) deposited radially on an inner cylindrical surface 315 of the drill pipe 110. The dielectric insulator 310 is thus located in the interior passage 128 of the drill pipe 110.

The drill string 108 therefore effectively provides a so-called two-wire conductor comprising the outer conductive path 204 and the internal conductive path 208, although it should be noted that neither of the conductive paths in the example embodiment comprises a wire. All internal conductive elements (in this example the conductor segments 320 and the drilling fluid 220) are sufficiently electrically insulated from the outer conductive drill pipe 110 so as to remove shunt losses between the conductive paths 204, 208 as a significant factor in signal propagation. A transmitter 240 (shown only schematically in FIG. 2) that forms part of the downhole transceiver sub 124 may thus, for example, transmit an electromagnetic data signal uphole along the transmission line 200 to a receiver 250 (shown only schematically in FIG. 2) forming part, for example, of the uphole transceiver sub 127. The transmitter 240 may thus be separately connected to the internal conductive path 208 and to the outer conductive path 204 to apply alternating voltage differences over the separate conductive paths 204, 208, to generate an electromagnetic wave that propagates along the transmission line 200. Such electromagnetic waves may be used as a data signal by modulating one or more parameters of the waves, in conventional fashion. To this end, the receiver 250 may receive the data signal by measuring alternating voltage differences over the internal conductive path 208 and the outer conductive path 204 at the uphole transceiver sub 127. Further details with respect to the electrical circuit formed by the transmission line 200 are described in further detail below with reference to FIG. 5, while expected signal properties may also be understood with reference to the description below pertaining to FIGS. 6 and 7. Control data or other information may likewise be transmitted from the uphole transceiver sub 127 to the downhole transceiver sub 124.

Figure 4A:
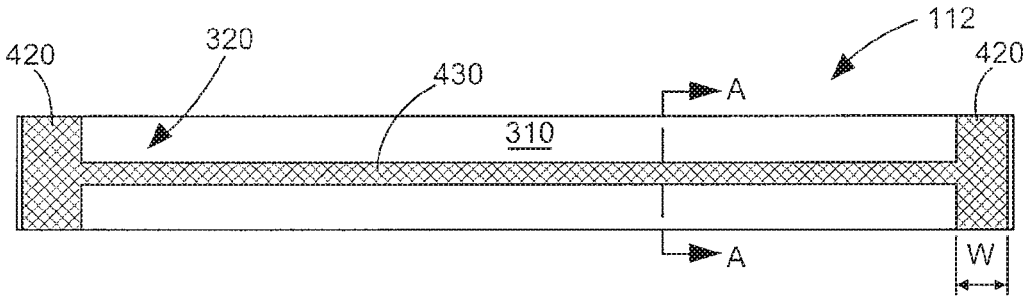
FIG. 4A depicts a schematic view of an inner cylindrical surface of the drill pipe of the example drill pipe of FIG. 3.
Figure 4B:
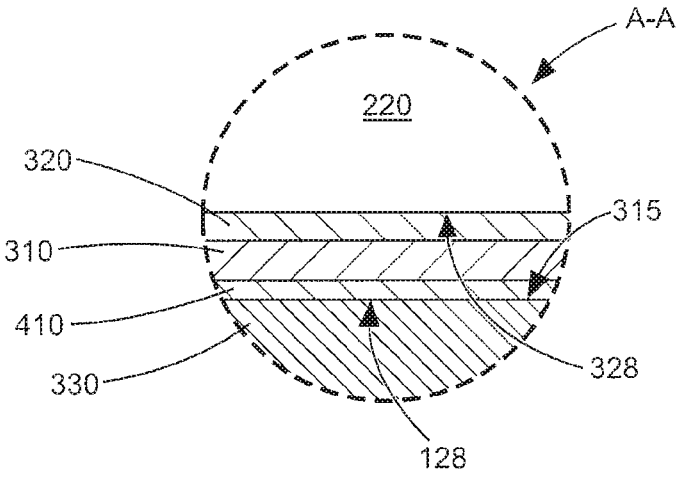
FIG. 4B depicts a cross-sectional view, on an enlarged scale, of the inner cylindrical surface of the drill pipe of FIG. 4A.

FIG. 4A is a schematic view of the radially inner surface (when laid flat) of one of the pipe sections 112 forming part of the drill string 108 in accordance with the example embodiment of FIG. 1, showing an example configuration of a conductor segment 320 provided by the pipe section 112. In this example, the conductor segment 320 comprises a coated layer of an electrically conductive material, in this case being a layer of NiCr coating. Attachment of the conductor segment 320 to the radially inner surface 315 of the tubular wall 330 in accordance with an example embodiment is shown in FIG. 4B. A binder 410 in the form of a 0.001-0.003" thick NiCr bond coat is provided directly on the inner cylindrical surface 315 of the tubular wall 330. The dielectric insulator 310 is provided on the binder 410, in this example being a ceramic coating such as, for example, Norton #252 Zirconium Oxide (perhaps with 5% CoO). The thickness of the dielectric insulator 310 in this example is 0.1". The NiCr coating that provides the conductor segment 320 is provided on the dielectric insulator 310. The conductor segment 320 is thus exposed to drilling fluid 220 in the fluid conduit 328, and is electrically insulated from the conductive material of the tubular wall 330 by the dielectric insulator 310.

Turning again to FIG. 4A, it can be seen that the conductor segment 320 comprises two electrodes 420 adjacent opposite ends of the pipe section 112, with an elongated narrow conductor strip 430 extending between the electrodes 420, connecting the electrodes 420 together. Each electrode 420 is annular or ring-shaped, extending circumferentially around the cylindrical interior of the fluid conduit 328. The electrodes 420 serve to promote propagation of the electromagnetic data signal wave over the gaps 305 between adjacent electrodes 420 through the drilling fluid 220. The electrodes 420 may have a dimpled or roughened radially inner surface that faces the fluid conduit 328, to promote conduction between the drilling fluid 220 and the conductor 230. In some embodiments, the electrodes 420 may have a greater thickness than the conductor strip 430.

In the example embodiment, the tubular wall 330 of the drill pipe 110 has an outer diameter of 4.5 inches and an inner diameter of about 3.8 inches. Each electrode 420 has a width dimension (w) in the longitudinal direction of the pipe section 112, the width of each electrode 420 in the current example being 4 cm. A ratio between the width of the electrodes 420 and an internal diameter of the interior passage 128 is thus about 0.41 in the current example, and about 0.3 to about 0.5 in some embodiments. The pipe sections 112 are manufactured such that the electrodes 420 are spaced from the adjacent end of the pipe section 112, when the pipe section 112 is new, by about 9 cm in the lengthwise direction of the pipe section 112. The width of the annular gap 305 (see FIG. 3), in the lengthwise direction of the drill pipe 110, between adjacent electrodes 420 of two such pipe sections 112 is thus initially about 18 cm. Note that the ends of pipe sections 112 may be cut back during the lifetime of a pipe section 112, so that width of the gaps 305 may be smaller for older pipe sections.

Analysis of Example Signal Mechanics

Some advantages associated with transmitting electromagnetic waves over a transmission line comprising the drill pipe 110 and a second conductive path internal to the drill string 108 may be illustrated with respect to the theoretical analysis set out below.

At the frequencies used in EM telemetry that uses Earth formations as one conductive path, EM field behavior for telemetry is actually more akin to a resistive network, since the wavelength is typically far greater than the length of the relevant well bore. Reactive components are not significant until much higher frequencies are used, where the telemetry path length starts to approach the communication wavelength.

The wave length in earth formations is a function of the velocity of the EM wave. The velocity in the earth is described by the formula:

$$v_e := \frac{1}{\sqrt{u_r \cdot u_0 \cdot \varepsilon_r \cdot \varepsilon_0}} \tag{1}$$

Where:

$u_r$=is the magnetic relative permeability of the formations $u_0$=the magnetic permeability of free space $\varepsilon_r$=the relative permittivity of the earth formation $\varepsilon_0$=the electrical permittivity of free space constant For propagating the signal through the earth, unless there are massive layers of magnetic or paramagnetic material (usually not where drilling for oil or gas occurs) the magnetic relative permeability is approximately 1. The electric permittivity in a lossy medium is a function of formation conductivity and the transmit frequency. The relative permittivity is more significant at higher data rates (those of ordinary skill in the art are well aware of this fact, and those who desire more information may refer to U.S. Pat. No. 7,363,160, incorporated herein by reference in its entirety) where the conductivity of the formation becomes significant. Using a worst-case scenario, consider water under static conditions, and use a relative permittivity value of 88. The effects of frequency will be examined later, when system limits are considered.

$u_r$=1

$u_0$=4×π×$10^{-7}$ H/m $\varepsilon_r$=88 for water $\varepsilon_0$=8.854×$10^{-9}$ $C^2/N{\cdot}m^2$ Thus the wave velocity in m/s at very low frequencies is approximately $$v_e := \frac{1}{\sqrt{1 \cdot 4 \cdot \pi \cdot 10^{-7} \cdot 88 \cdot 8.854 \cdot 10^{-12}}} = 3.196 \times 10^7 \tag{2}$$

Now that the wave velocity of the signal has been established, the wavelength is calculated as $$\lambda := \frac{v_e}{f} \tag{3}$$

f=frequency in Hz

At 25 Hz (ignoring the effects of conductivity), the wavelength is then:

3.196×$10^7$/25=1,278,400 meters (794 miles)

Even with 5000 m (3.1 miles) wells, this is well under the limits of the system approaching a wave length at 25 Hz. This demonstrates that the principle factor affecting earth formation EM telemetry signals is possibly resistance and not effects due to reflection, group delay, or other factors that come into play in the higher frequency realm where wavelength geometries are a factor.

A further consideration is skin depth for salt water. The skin depth is basically the propagation distance through a material that an electromagnetic wave can propagate until the amplitude has dropped by $e^{-1}$ or about 63% of the source signal. It is well-established that the higher the frequency, the greater is the signal attenuation, and that this function is logarithmic. To get higher data rates, for example in the hundreds of thousands of hertz, it will be necessary to shorten the distance the wave has to propagate through the lossy medium. There are thus not only losses associated with the frequency due to the formation conductivity (and thus eddy currents), but there are also losses associated with static series resistance of the formation.

Data rates may be boosted significantly by a transmission mechanism such as that described in the above example embodiment, using an internal conductive path as a second conductive path instead of earth formations. This may be due, firstly, to an increase in transmission frequency that results in a substantial reduction in losses due to resistance and impedance, and, secondly, creation of a more favorable conductive path that helps to reduce these losses.

The example embodiment of FIGS. 1-5 avoids formation resistance dependencies, while reducing a resistive path across the tool joints 210 without employing connectors to eliminate the gaps 305. Transmit frequency wave length in the example transmission mechanism may be kept substantially lower than the length of the drill string, in which case accumulated gap losses due to series resistance and skin depth effects do not attenuate the signal much more than what can be detected by the receiving end. An additional benefit is that the signal jumps through lossy intervals of a total fraction of the distance that a signal required to jump through over the entire length of the formation, were the formation to be used as the second conductor. The internal conductive path 208 thus provides a superior electrical path, when compared with the formation.

The transmission line 200 provided by the drill string 108 may be likened to a thin leaky hose where water spills out all the way along its length. However, so long as even a drop of water gets to the other end of the hose, a usable signal is transmitted. The example data transmission system reduces the size of the "leaks" and uses a much smaller "hose," compared to the entire diameter of a drilling lease, as is the case with earth formation EM telemetry.

At low frequencies, the fluid conduit 328 and the drill pipe 110 may essentially become a lossy wave guide, confining the signal within. The conductivity of the drilling fluid 220 and the segmented conductor 230 placed on the radially inner side of the dielectric insulator 310, which are not electrically connected to the conductive material of the drill pipe 110, acts as one conductor (i.e. the internal conductive path 208 in the example embodiment), while the drill pipe 110 acts as another, separate conductor (i.e. the outer conductive path 204).

The transmission line 200 at relatively low frequencies can essentially be modeled with a simple resistive network. At higher frequencies, inductance and capacitance of the network transmission line 200 may become a factor and can be represented in a simplified circuit 500 shown in FIG. 5A. However, calculations show that a transmission frequency well in excess of the 12-25 Hz range typically utilized in earth formation EM telemetry may comfortably be surpassed in the example embodiment.

For example U.S. Pat. No. 6,770,603 B1 (incorporated herein by reference in its entirety) discloses that at 500 Hz in an oil-based mud, the conductivity of the mud can be measured at 0.02 S/m or 50 ohm-m resistivity. This is without the added benefit of the conductor 230 or an inner conductive layer on the inside of a dielectric barrier such as the dielectric insulator 310. Such a resistance level would make conceivable propagation of a 1 Watt signal through the drilling fluid 220 exclusively over this lossy conductor for 1000 m with a 50 dB drop in signal. Ignoring shunt resistance for the moment, a low frequency signal could propagate under these conditions a distance of 6324+m with a 55 dB signal attenuation, or 623 m with a 45 dB signal attenuation. Detection down to the 90 dBm ranges are possible are possible with the above-described example embodiment, especially when the system operates in a spectrum where the noise is very limited at the rig site. Such surface noise is a difficulty of conventional Electromagnetic Measurement While Drilling (EMMWD) activity, since the transmission spectrum is heavily affected by surface noise from electrical equipment at the rig.

An important factor at low frequencies is shunt resistance. If the shunt resistance is significantly increased in comparison to the series resistance, then the signal attenuation is primarily controlled by the conductance of the drilling fluid. The shunt path may in some embodiments be reduced to negligible values by insulating as much as possible the metal of the drill pipe 110 from contact with the drilling fluid 220, particularly at the joints 210 (see for example FIG. 3). Since the shunt path is a function of current path flow area, any nicks or minor local defects in the dielectric insulator 310 will not have a dramatic effect on shunt losses across the connection, provided that it is near the center of the gap 305. Nevertheless, it is useful to reduce the shunt path as much as practical.

Figure 5A:
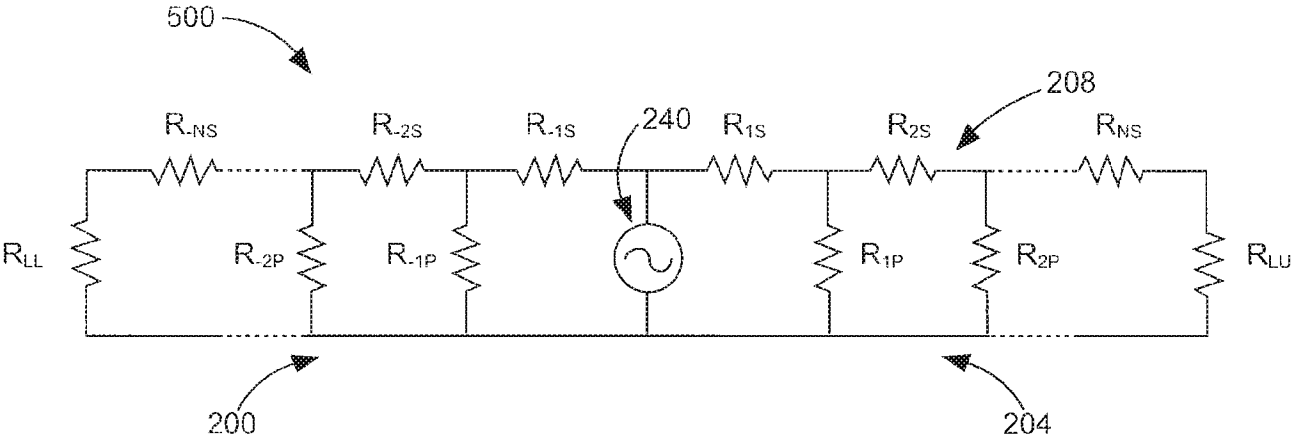
FIGS. 5A and 5B are simplified schematic circuit diagrams of a transmission line provided by a drill string in accordance with respective example embodiments.

Turning now to FIG. 5A, the transmission line 200 is shown to include a transceiver in the form of the transmitter 240 provided in the drill string 108. Resistors indicated in FIG. 5A as $R_{-xS}$ resistors are resistive networks below the transmitter 240 and resistors indicated as $R_{+xS}$ resistors make up the resistive network above the transmitter 240. The letter "S" indicates that these resistors represent series resistance of the drilling fluid 220 and any inner insulated conductor (such as the internal structural conductor 230) separate from the drill pipe 110.

The upper portion of the model circuit 500 of FIG. 5A contains the resistance along the internal conductive path 208, while the lower portion of the model circuit 500 represents current traveling on the outer conductive path 204 provided by the drill pipe 110. Since the drill pipe 110 is highly conductive, no resistance is shown and the outer conductive path 204 is essentially (for modeling purposes) zero resistance. The resistive network has two parts, separated by the transmitter 240. The part of the resistive network below the transmitter 240 is also of importance. While the transmitter 240 in FIG. 5A is shown, for ease of description, to be a transmitter source of an alternating current generator, the transmitter 240 may basically be a transceiver used for both transmitting and receiving, and may in the example embodiment be provided as part of the downhole transceiver sub 124. On each end of the circuit 500 this is another transceiver or end point represented as an upper receiver load ($R_{LU}$) and a lower receiver load ($R_{LL}$) respectively. For clarity of description, the upper receiver load ($R_{LU}$) is further referred to as the receiver, and is indicated by reference numeral 250, similar to its designation in FIG. 2.

Figure 5B:
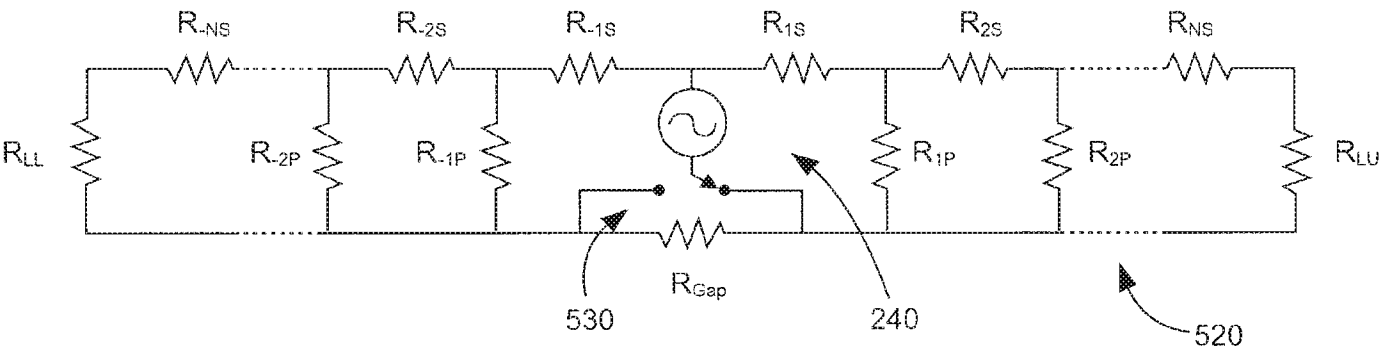

For the transceiver ($R_{LU}$) on the bottom of the drill string 108, energy transmitted to the bottom hole assembly 118 may be wasted by robbing power from the transmitter 240. FIG. 5B illustrates a mechanism to increase the downward resistance, by positioning an electrical gap (indicated $R_{GAP}$) below the location of the transmitter 240, to boost the series resistance of the lower loop, preferably by $R_{-1S.}+R_{GAP}$. In one embodiment, $R_{GAP}$ could be provided by placing a standard EM antenna sub below the transmitter 240. In other embodiments, a toroid may be mounted on the collar to act as an electrical choke to stop signal propagation downward. Toroid leads in such case would be shorted to each other, thereby allowing for a counter electromotive force (EMF) to be established and thereby to effectively increase the series resistance. In yet a further embodiment, a large loop current may be injected locally. Such a large loop current would consume most of the current carrying capacity of a localized loop and therefore increase the resistance of additional current flow from other sources, which may use high currents to establish the effect.

FIG. 5B illustrates a network circuit 520 in accordance with an alternative embodiment that includes a switch 530 over the outer conductive path's electrical gap or choke ($R_{GAP}$). The switch 530 provides separate launch points on each side of the electrical gap ($R_{GAP}$), to ensure that signal power propagates mostly in the desired direction and is not consumed by the resistive network going in the wrong direction. While not shown, a receiver could be switched in on the opposite side of the gap ($R_{GAP}$) to receive in an incoming signal from one direction, while the transmitter 240 is transmitting in the other, switched-in direction.

Returning now to the model circuit 500 of FIG. 5A, it will be seen that it is beneficial to restrict electric current in the internal conductive path 208 provided in the interior passage 128 of the drill pipe 110 from shorting to the outer conductive path provided by the drill pipe 110. The dielectric insulator 310 in the example embodiment provides this function. It is also be seen with reference to FIG. 5A that it is desirable to increase the resistance of all the parallel resistors and reduce the resistance of all the series resistors.

Calculating the expected electrical resistance of the inner electrical gap 305 of the internal conductive path 208 is a function of various distances, conductor surface areas and conductance of the drilling fluid 220. One study with respect to an example embodiment analogous to that described with reference to FIGS. 1-5 comprised performing finite element analysis (FEA) to model an electric field across the junction or gap 305, to determine the gap resistance. The FEA was performed using Ansys12, which has limited capabilities but was adequate to extract resistive load drops for low frequencies across the gaps 305.

The study comprised taking the inner diameter of 4.5" drill pipe 110 and analyzing the effects of the gap distance (d) in the lengthwise direction of the drill string 108 (see FIG. 3) and the electrode width (w) (see FIG. 4A) to determine variations in lossyness of the junction for various parameters. Each electrode 420 was modeled an annular band coaxial with and provided at opposite ends of a cylinder of transmission material equal in radius to the inner diameter of the interior passage 128. The material between the bands representing the electrodes 420 was modeled with sea water which has a nominal conductivity of 4.788 S/m at 0.2089 ohm-m.

To derive some generalized formula, it was beneficial to determine at what gap distance (d) the resistance becomes linear as a function of gap distance, because the resistance behavior becomes more nonlinear as the gap 305 gets smaller. This allows determination as to whether the internal conductive path 208 would benefit from a joint coupling and to assess the benefits associated with very wide electrodes, even to the point of lining the entire cylindrical surface of the interior passage 128 of fluid conduit 328 with an exposed electrode. Such a construction would effectively do away with the narrow strip 430 (see FIG. 4A), so that the annular electrodes 420 would extend along the length of the pipe section 112. This construction may promote high frequency carrying content due to increased capacitance per unit length. It may also benefit maintenance with respect to the tool joint 210, which could then be constructed for routine cutbacks without the need of redressing the electrode 420. Such a feature may benefit both in down time for the drill pipe 110 and maintenance costs labor. It is desirable in the data transmission system to minimize capacitance, maximize flow area and simplify cutbacks to be manageable for the machine shop. Interestingly, as a pipe section 112 gets more and more cut backs done on it, signal loss is reduced because the size of the gap 305 is decreased. Hence, the longer a pipe section 112 or a drill pipe 110 is in service, the more effectively it operates as each cut back reduces the gap resistance somewhat more.

Figure 12:
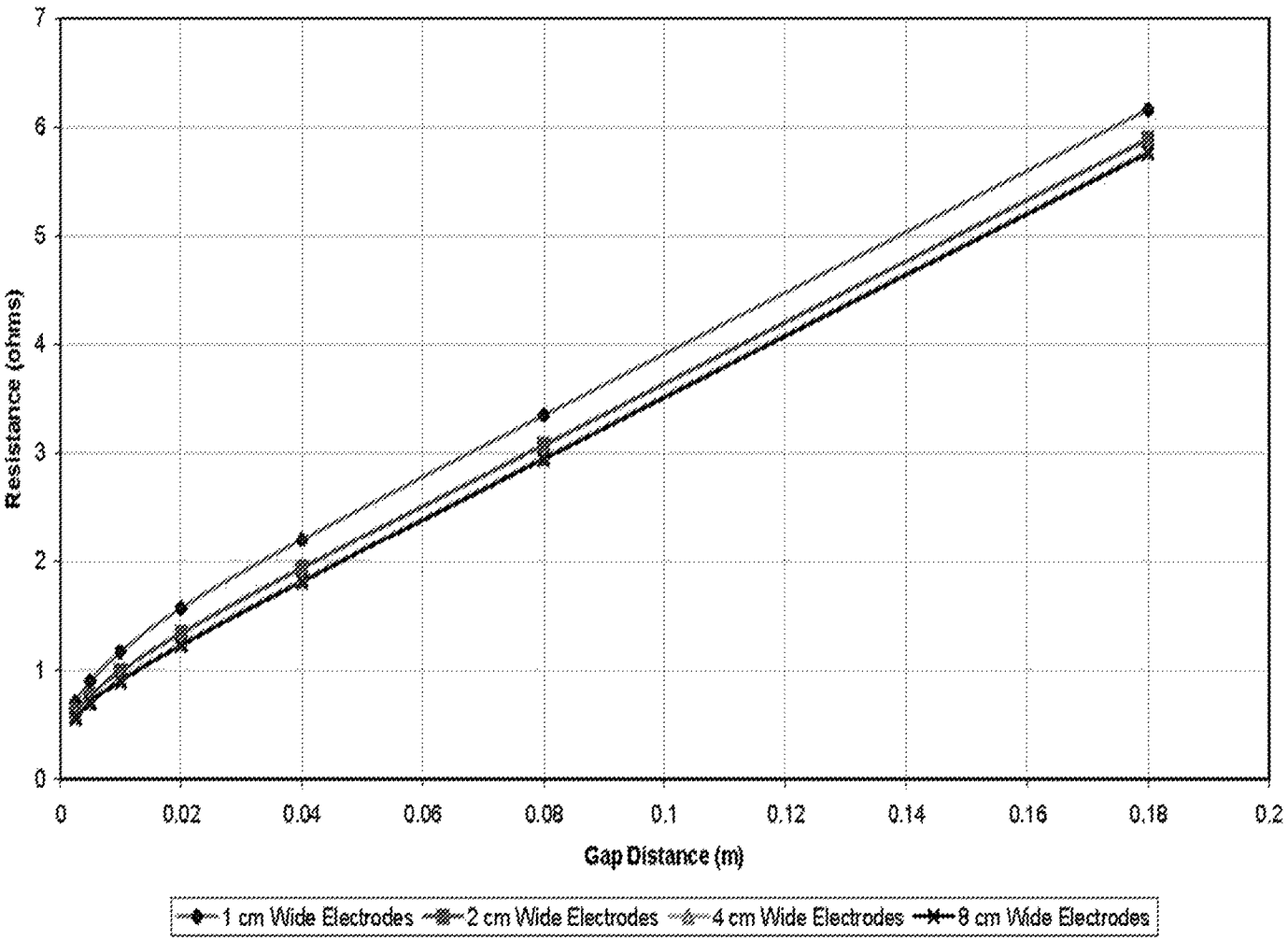
FIG. 12 is a chart showing results of a FEA study, according the certain illustrative embodiments of the present disclosure.

Results of the above-described FEA study are shown in FIG. 12.

The study shows that the slope of the lines is relatively constant with an electrical gap distance (d) of about 2 cm or greater. This slope represents a static 28.16 ohms/m resistance per unit length of fluid in the drill pipe 110 regardless of the width (w) of the electrodes 420. The gap resistance is primarily a function of the cross sectional area of the drilling fluid 220 (and therefore of the interior passage 128) and the conductivity of the drilling fluid 220. Electrode width above 4 cm (which is approximately ½ the diameter of the drill pipe 110 in the current example) has little practical contribution. Notably, the cross sectional surface area of the drill pipe 110 inner diameter is the same as the cylindrical surface area of the electrode 420 when the electrode width (w) equals ½ the diameter. Also the electric field across the gap 305 is not linear in its radial profile, but the distribution of flux remains constant the further the electrodes 420 are spaced apart.

Even with an 18 cm gap 305 (which is relatively large for cut backs, and not shown in FIG. 12) the gap resistance is about 6 ohms while the resistance that is to be expected through the drilling fluid over 9.5 m of the length of a pipe section 112 would be about 267.52 ohms (9.5 m×28.16 ohms/m).

The study thus revealed a ratio of 2.2% of gap loss verses pipe length loss. Therefore, by transmitting over the gaps 305 in a manner consistent with the above-discussed example embodiment, the series signal loss of the resistive network is greatly reduced when compared to an alternative example embodiment in which the internal conductive path is provided primarily by the drilling fluid, so that the signal is propagated entire length of the drilling fluid 220 between the transmitter 240 and the receiver 250. The latter construction is somewhat analogous (as it relates to electrical resistance) to propagation of the signal through earth formations in the conventional EM mode of signal propagation, although such a construction may still display notable advantages over the conventional EM signal propagation mode.

The study results are also significant for designing the location of end points of the transmission line 200, as it is preferable to limit short circuit effects when trying to launch or, particularly, extract a signal from the transmission line 200. Of particular interest is the implication that a properly constructed resistive network of the internal conductive path 208 should be able easily to propagate signals in the drilling fluid 220 without an inner structural conductor 230 for short distances to a few thousand meters, if desired. Some embodiments may include some pipe sections 112 of the drill string 108 with conductor segments 320, and at least some pipe sections that do not have any inner conductor elements, being provided only with a dielectric insulator 310 to separate drilling fluid 220 therein from the conductive material of the drill pipe 110. Although losses are much higher without an inner conductor (e.g., at a fluid series resistance of 28 ohms/m) a 5000 m well would have a series resistance of 140,000 ohms. Even though such a series resistance may seem large, it is well within the capabilities of electronic amplifiers to extract a signal that is attenuated by a series resistance of this magnitude, being expected to cause a signal loss of about 60-70 dB.

Figure 6:
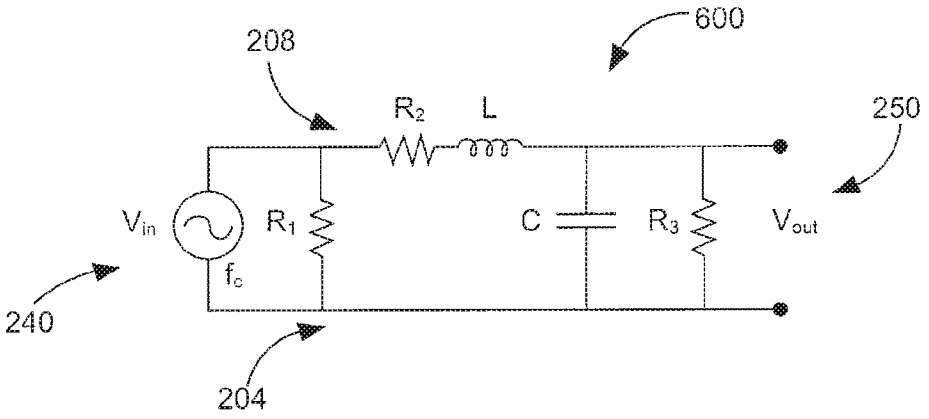
FIG. 6 depicts a simplified schematic circuit diagram of a higher frequency transmission line provided by a drill string in accordance with another example embodiment.

FIG. 6 shows a higher-frequency system equivalent circuit 600 for the transmission line 200 of the example embodiment described with reference to FIGS. 1-5, in which source resistance is for the moment ignored. In FIG. 6:

$R_1$=shunt resistance near the transmitter 240;

$R_2$=series resistance along the internal conductive path 208;

L=series inductance of the 2-wire transmission line 200;

C=cumulative capacitance of the internal conductive path 208 with the outer conductive path 204 provided by the tubular wall 330 of the drill pipe 110; and $R_3$=shunt resistance at the receiving end, adjacent the receiver 250.

With reference to the system equivalent circuit 600, it can be seen that, to reduce losses, it is desirable for R1 and R3 to the much larger than R2, while L and C should be as small as feasible, preferably approaching zero.

The implications of the model circuit 600 for the efficacy of the transmitter 240 located in the downhole transceiver sub 124 near the bottom of the drill string 108 of another example embodiment will now be considered. The example embodiment with reference to which the following calculations are performed are similar or analogous in its mode of operation and signal transmission mechanics, with like reference numerals indicating like or analogous elements, a major distinction being that the conductor segments 320 of the inner structural conductor 230 is provided by a hydroformed rubber-coated liner attached to the inner cylindrical surface 315 of the drill pipe 110. A similar construction is described in greater detail below with reference to FIGS. 10A and 10B. The liner comprises a cylindrical dielectric insulator 310 sandwiched between the drill pipe 110 and the conductor segment 320, which is a cylindrical layer or jacket of conductive material. The interior surface of the cylindrical conductor segment 320 may be covered by an erosion protection layer that exposes annular bands of the conductor segment at opposite ends of each pipe section 112, to provide the ring-shaped electrodes 420.

For $R_1$, assume that the signal is launched at the top end of one pipe joint 210. Assume that means that an internal cylindrical surface of a pipe section below the signal launch point is not insulated and effectively becomes a dead short to the current traveling downwards.

Figure 7:
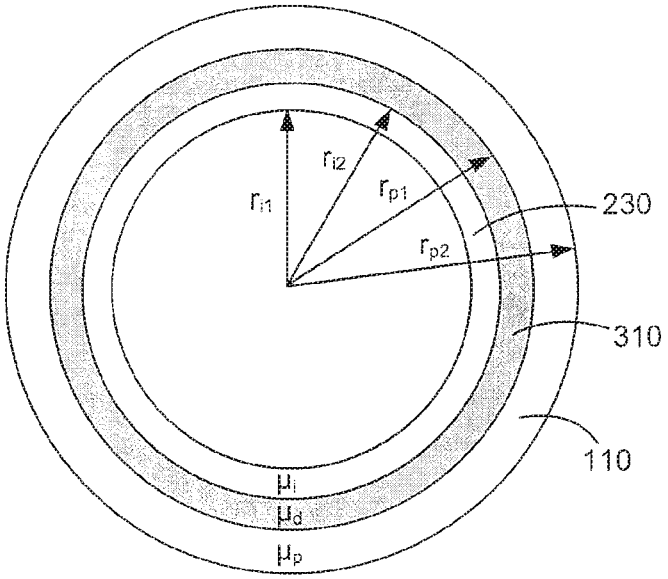
FIG. 7 depicts a schematic cross-sectional view of drill pipe in accordance with yet another example embodiment.

Regarding $R_2$, the series resistance may greatly be reduced by providing an electrical connector or coupler in each tool joint 210 (see for instance the example connectors 805 described below with reference to FIG. 7). Instead, the gap 305 between adjacent electrodes 420 may be made as small as is feasible. For the purposes of assessing the example embodiment, the model is based on using an 18 cm gap with 4 cm electrodes, similar to the dimensions of the example embodiment of FIGS. 1-5 and in accordance with the above-discussed FEA study results.

The gap resistance per tool joint 210 is about 5.8 ohms. Assuming a pipe length of 9.5 m for each pipe section 112, a drill string 108 in a 5000 m well bore as an approximate series resistance ($R_2$) of 610Ω per 1000 m (1000/9.5*5.8). It is assumed for the moment that the part of the internal conductive path 208 provided by the segmented structural conductor 230 has a negligible resistance.

The capacitance (C) in the transmission line 200 is a function of the mutual surface area of the inner diameter or inner cylindrical surface 315 of the drill pipe 110 and the surface area of the outer diameter of the inner conductor 230, a separation distance, and the dielectric constant of the insulating material of the dielectric insulator 310 sandwiched between the materials of the inner conductor 230 and the drill pipe 110. For the currently considered example embodiment in which the inner conductor segments 320 are provided by hydroformed rubber coated liners, pipe capacitance plus an approximation for the capacitance across the electrical gap 305, in which the example embodiment includes a 0.5 mm ceramic coating over the radially inner surface of the drill pipe 110 in parallel with the liner capacitance. A generalized example may be calculated as follows. Again each pipe section 112 is 9.5 m long. The liner interval is 9.15 m (9.5 m-2×0.18 m). The radius of the inside of the drill pipe 110 is 48.6 mm (97.2/2). The radius of the outer side of the conductive portion of the liner is 45.4 mm (about a ⅛" thick rubber layer providing the dielectric insulator 310). The thickness of the dielectric layer 310 is 3.2 mm. The dielectric constant will be a nominal 3.0 for the moment.

The capacitance $C_p$ of a pipe section 112 between the two cylinders can be a described by the following equation:

$$C_p := \frac{k \cdot 1}{2 \cdot k_e \cdot \ln\left(\frac{b}{a}\right)} \tag{4}$$

Where:

k=dielectric constant (of the rubber in this case)

l=length (m)

$k_e$=Coulombs constant $1/(4*\pi*\varepsilon_0)=8.9875\times10^9$ b=outer radius a=inner radius Substituting we get:

$$C_p := \frac{3 \cdot 9.15}{2 \cdot 8.9875\ 10^9 \cdot \ln\left(\frac{0.0486}{0.0454}\right)} = 2.242 \times 10^{-8}\ \text{Farads}$$

or 22.42 nF.

With respect to the capacitance over the 18 cm gap is noted that this capacitance is not trivial since the charge density is dispersed in a non-linear fashion over the radius of the drilling fluid, which in effect provides a conductor forming part of the internal conductive path 208 at the joint 210. For current purposes, simplified worst-case calculations are performed to determine whether the gap capacitance is a significant factor in the transmission line 200. In the example embodiment on which these calculations are based, the gap 305 comprises a metal conductor pairing directly against a ceramic coating layer of Zirconium Oxide, which is about 0.5 mm thick. The relevant variables are thus as follows:

L=0.18 m a=0.0486−0.005=0.0436 m b=0.0468 m k=12.5

Substituting we get:

$$C_{gap} := \frac{12.5 \cdot 9.15}{2 \cdot 8.9875\ 10^9 \cdot \ln\left(\frac{0.0486}{0.0436}\right)} = 5.861 \times 10^{-8}\ \text{Farads}$$

Or:

58.61 nF.

The two parallel capacitances may be combined as follows:

$C_p+C_{gap}=C$ 22.42+58.61=81.03 nF

Over 1000 m of pipe the total capacitance is:

1000/9.5*81.03=8529 nF

Or:

8.529 μF per 1000 m

Because there is not an order of magnitude difference between the above-calculated gap capacitance and the structural conductor capacitance, further analysis of the general model may be performed without further considering the gap capacitance in greater complexity. Assuming that the above-calculate the capacitance is a worst-case scenario that may reasonably be considered, reactance may be plotted versus frequency using the formula:

$$X=1/(2*\pi*f*C*1000/9.5)$$

Where

X=the intrinsic impedance of the capacitor in ohms;

C=the overall capacitance per 1000 m in Farads; and f=the transmit frequency of the signal in Hertz.

The result of such a plot shows, for example, that the reactance of the capacitor is roughly 200Ω per 1000 m at 100 Hz, and is roughly 20Ω at 1000 Hz. A number of different embodiments discussed herein have the result of reducing the transmission line shunt capacitance further than is the case with the currently considered example embodiment. The example embodiment of FIG. 4A, for instance, reduces shunt capacitance by providing conductor segments 320 having a narrow strip 430 instead of being cylindrical for the whole length of the pipe section 112.

Regarding series inductance (L), it is relevant that there is a relatively large component ferromagnetic material associated with the transmission line 200, in the form of the drill pipe 110 and, therefore less extent, the conductive material of the conductor 230. There are also limited means to restrain eddy currents given the geometry under consideration and the mechanical necessity for the drill pipe 110 and the conductor segments 320 in the example form of the conductive liner. Given the current levels the transmission line 200 is likely to employ, it is doubtful that the ferrous material of the drill pipe 110 will be driven into magnetic saturation, but the effects of on the inductance can become significant. At higher frequencies a formula for calculating the inductance of the two cylinders can be as follows and may best be understood with reference to FIG. 7, which shows a cross sectional view of a drill pipe 110 in accordance with the currently examined example in an embodiment having conductor segments 320 in the form of a cylindrical liner:

$$L := \mu_d \cdot \frac{1}{2\cdot\pi} \cdot \ln\left(\frac{b}{a}\right) \tag{5}$$

Where

L=inductance in Henrys (H);

$u_d$=the permeability of the material with is the permeability of free space $u_0$ (the relative permeability $u_r$ of rubber in this example ($u_d$=$u_r$ $u_0$) and since rubber has a relative permeability of 1 in this case $u_d$=$u_0$)

l=length (m)

a=the outer radius of the conductive liner b=the inner radius of the drill pipe

However, this equation does not take into account the effects of the iron, particularly in the drill pipe 110, since the liner of the conductor segment 320 is much thinner than the drill pipe 110. At very low frequencies and signal current levels where the conductor segment 320 and the drill pipe 110 thickness is much smaller than the relevant skin depth, the following formula (equation 6) may be employed to calculate the inductance per unit length of the drill pipe 110, dielectric insulator 310, and the liner providing the conductor segment 320 over the interval where the conductor segment 320 and the drill pipe 110 coincide:

$$L' := \underbrace{\left[\frac{\mu_i}{2\cdot\pi}\left(\frac{r_{i2}^2}{r_{i2}^2 - r_{i1}^2}\right)^2 \ln\left(\frac{r_{i2}}{r_{i1}}\right) - \frac{\mu_i}{4\cdot\pi}\left(\frac{r_{i2}^2}{r_{i2}^2 - r_{i1}^2}\right) - \frac{\mu_i}{8\cdot\pi}\right]}_{\text{Inductance of Inner Liner}} + \underbrace{\left(\frac{\mu_d}{2\cdot\pi}\cdot\ln\left(\frac{r_{o1}}{r_{i2}}\right)\right)}_{\text{Inductance of Rubber Region (dielectric)}} + \underbrace{\left[\frac{\mu_p}{2\cdot\pi}\left(\frac{r_{p2}^2}{r_{p2}^2 - r_{p1}^2}\right)^2 \ln\left(\frac{r_{p2}}{r_{p1}}\right) - \frac{\mu_p}{4\cdot\pi}\left(\frac{r_{p2}^2}{r_{p2}^2 - r_{p1}^2}\right) - \frac{\mu_p}{8\cdot\pi}\right]}_{\text{Inductance of Drill Pipe}}$$

Where (all lengths in meters):

$\mu_i$=magnetic permeability of the liner material (inner conductor 230)

$r_{i1}$=inner radius of the liner (inner conductor 230)

$r_{i2}$=outer radius of the liner (inner conductor 230)

$\mu_d$=magnetic permeability of the rubber dielectric layer (insulator 310)

$\mu_p$=magnetic permeability of the drill pipe (110)

$r_{p1}$=inner radius of the drill pipe (110)

$r_{p2}$=inner radius of the drill pipe (110)

This equation assumes that no current is flowing in the drilling fluid 220 over this interval, hence the self-induced magnetic field in the drilling fluid 220 is zero.

Using 4140 steel which has a resistivity of $2.2\times10^{-7}$ Ω·m as a base line example one can see that at 10,000 Hz the skin depth is roughly 2.5 mm and at 1,000 Hz the skin depth is about 7.8 mm. The wall thickness of 4½" drill pipe 110 is generally 10.92 mm. Depending on the signal operating range of the transmission line 200, the inductance is somewhere between the result of equation 5 and the result of equation 6. If in either case the inductance of the transmission line 200 presents significant reactance and thus impacts signal attenuation significantly, skin effects may be modeled. The inductance is then be calculated as follows:

$$L := \mu_d \cdot \frac{1}{2\cdot\pi} \cdot \ln\left(\frac{b}{a}\right)$$

a=the outer radius of the liner b=the inner radius of the drill pipe

=$\mu_X \cdot \mu_C = \mu_C$ for rubber $$\mu_0 = 1.257\times10^{-6}\frac{T\cdot m}{A}$$

$\mu_d := \mu_C$ a:=0.0436 m b:=0.486 m $l_p$:=1000 m $$L_{string} := \frac{1.257\times10^{-6}}{2\cdot\pi}\cdot\ln\left(\frac{0.0486}{0.0436}\right)$$

$L_{string}$=21.7 nH/m

Geometry changes at the joints 210 are ignored to avoid unnecessary complexity, and the equation is modeled for a continuous long hollow core coaxial conductor provided by the transmission line 200. At high frequencies, the inductance may thus be about 21.7 μH/1000 m. The reactance per 1000 m as attributed to the inductance can then be plotted against frequency using the equation $X_L$=2*π*f*L.

The results of the above theoretical analysis reveal substantial advantages of the considered example embodiment over conventional EM telemetry systems. Even at a 10,000 Hz transmit frequency the calculated overall series reactance of the exemplary transmission line 200 is about 1.5Ω. Based in part on these calculations and experiments, the data rates achievable from this system are expected to reach 500-1000 bits per second or more.

It is a further advantage of the example embodiment of a data transmission system and method described above that it provides for propagation of an electrical signal along the drill string 108 by utilizing a first conductor (in the example form of the internal conductive path 208) and utilizing the drill pipe 110 as the second conductor, to provide a two-path transmission line. Thus, rather than using the earth as an external conductive path (as in conventional EM telemetry systems), a more favorable internal path has been found in terms of the first internal conductor. In the example embodiment, this comprises the internal hybrid path 208 of an internal conductor 230 and short hops in the drilling fluid 220 over tool joints 210. The transmission path is essentially independent of formation effects, making the propagation model easier to manage under a wide variety of drilling conditions.

Modeling and network analysis indicate that this may be superior to prior data transmission mechanisms and that it promises a significant boost in data rates, as noted above. There are also commercial advantages in comparison to wired pipe methods that are sometimes employed in drill string telemetry.

Structural elements of the internal conductive path 208, such as the conductor segments 320, are further provided along the radially outer boundary of the interior passage 128, thereby intruding minimally into the fluid conduit. The conductor segments 320 of the position at the point of the drill pipe 110, when seen in cross-section, where fluid velocity is lowest, thereby reducing in increased pressure drop associated with providing the internal conductive path 208.

Many prior electrical path telemetry systems rely on a solid electrical contact at each pipe section joint. If that connection fails at any point along the drill string, the entire telemetry path fails. In addition, such systems utilize high speed communications and power. Various embodiments described herein assume that connections at tool joints 210 are lossy, and include this assumption in the overall telemetry model to compensate. In some embodiments, degradation of signal strength over time may be addressed by placing repeaters close enough together that any degradation encountered during a job can be handled by increasing the gain of the receivers and transmitter strength as required.

Example Embodiments with Joint Couplers

In some embodiments, the internal conductive path 208 may be provided substantially exclusively by structural conductor elements forming part of the drill string 108, so that conductance via the drilling fluid 220 does not form a significant part of the internal conductive path 208. For example, under balanced foam/$N_2$ drilling, a joint coupler or connector may be used to compensate for a relatively unreliable conductive path through foam in the interior passage 128. Such embodiments may also be used in air hammer drilling, where there is no drilling fluid used.

One such example embodiment is described with reference to FIG. 8, which shows a sectional side view of part of a drill string 108, in which the internal structural conductor 230 has a configuration different from that described with reference to FIGS. 1-5. The structural conductor 230 of FIG. 8 comprises conductor segments 320 on respective pipe sections 112 similar to those described with reference to FIGS. 3-4, but additionally comprising an electrical connector 805 at each joint 210 to bridge the electrical gap 305 between a pair of adjacent electrodes 420. Adjacent conductor segments 320 are thus electrically connected by respective connectors 805, so that the segmented internal structural conductor 230 may jump the tool joints 210 without shorting to the drilling fluid 220 or to the drill pipe 110.

Figure 8:
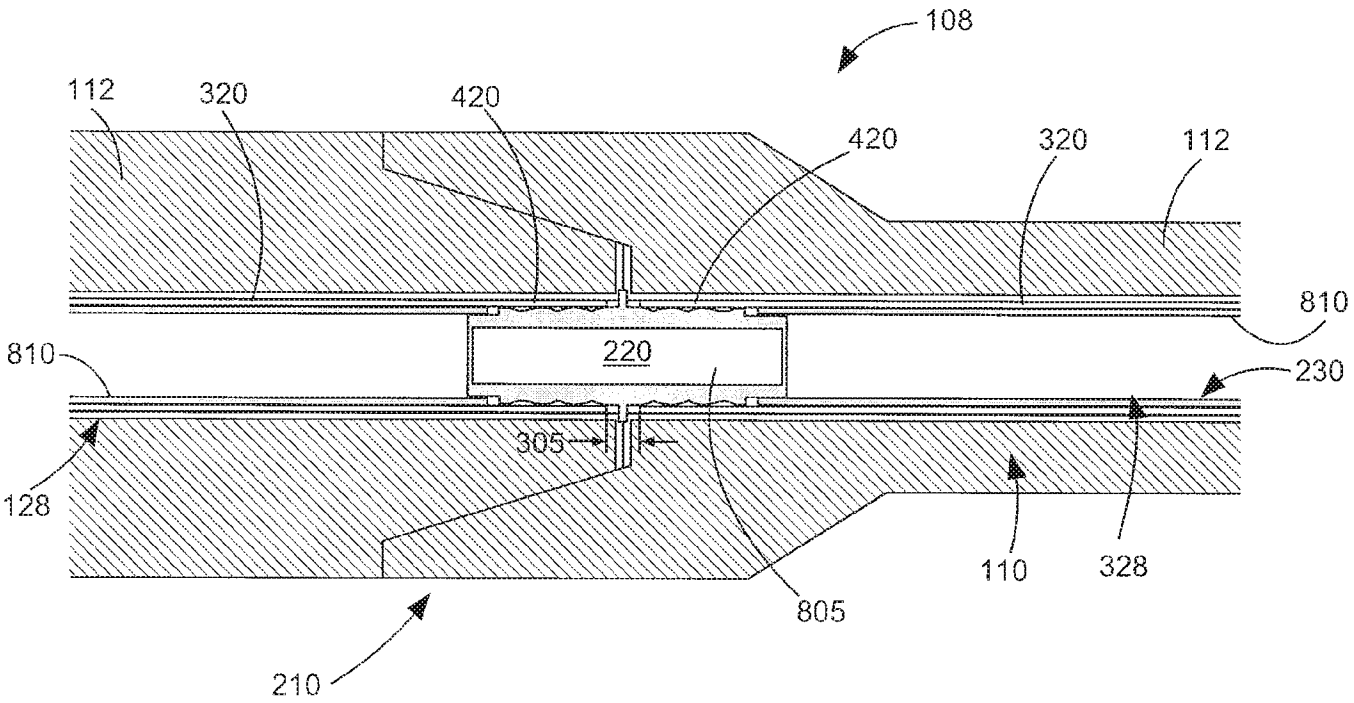
FIG. 8 depicts a schematic cross-sectional view of a pipe joint in a drill pipe in accordance with yet a further example embodiment.

Each pipe section 112 in accordance with the example embodiment of FIG. 8 further includes a protection layer 810 that extend circumferentially around the cylindrical outer boundary of the interior passage 128, lining the interior passage 128 and covering part of the associated conductor segments 320. The protection layer 810 may be of a material suitable to protect the conductor segments 320 from erosion and/or abrasion give to the flow of the drilling fluid 220 along the interior passage 128. The protection layer 810 of each pipe section 112 may stop short of the respective electrodes 420, exposing the electrodes 420 for contact with the connector 805. As can be seen with reference to FIG. 8, each connector 805 may overlap the protection layers 810 of both of the relevant pipe sections 112, so that the conductor segments 320 are entirely covered from contact with the drilling fluid 220 by the protection layers 810 and the electrical connectors 805.

It is an advantage of the embodiment of FIG. 8 that provision of the connectors 805 significantly lowers signal attenuation compared to embodiments in which the gaps 305 between conductor segments 320 are jumped through the drilling fluid 220. The conductor segments 320 and connectors 805 are thus effectively all connected in series.

In other example embodiments, a protection layer 810 such as that described with reference to FIG. 8 may be provided without the associated connectors 805, to cover strips 430 (see FIG. 4) of the conductor segments 320 while exposing the electrodes 420 for propagation of the electromagnetic signal between adjacent electrodes 420 through the drilling fluid 220. Hence, the configuration of FIG. 8 with or without the protection layer 810 may be advantageous.

The protection layer 810 may in some embodiments be a coating of a material that is selected to have a relatively low fluid friction factor to promote reduction in circulating pressure of the drilling fluid 220. The protection layer 810 may in such cases have a fluid friction factor with the drilling fluid 220 that is lower than a corresponding fluid friction factor of the drilling fluid with a steel or metal inner cylindrical surface of the drill pipe 110. Additives can also be made to the fluid to reduce the coefficient of friction in a pipe. U.S. Pat. No. 4,637,418 (incorporated herein by reference in its entirety), discloses that using certain compounds, including 2-acrylamido-2-methylpropanesulfonic acid or coal dust, may serve to reduce pipe friction, as is known to those of ordinary skill in the art.

Figure 9:
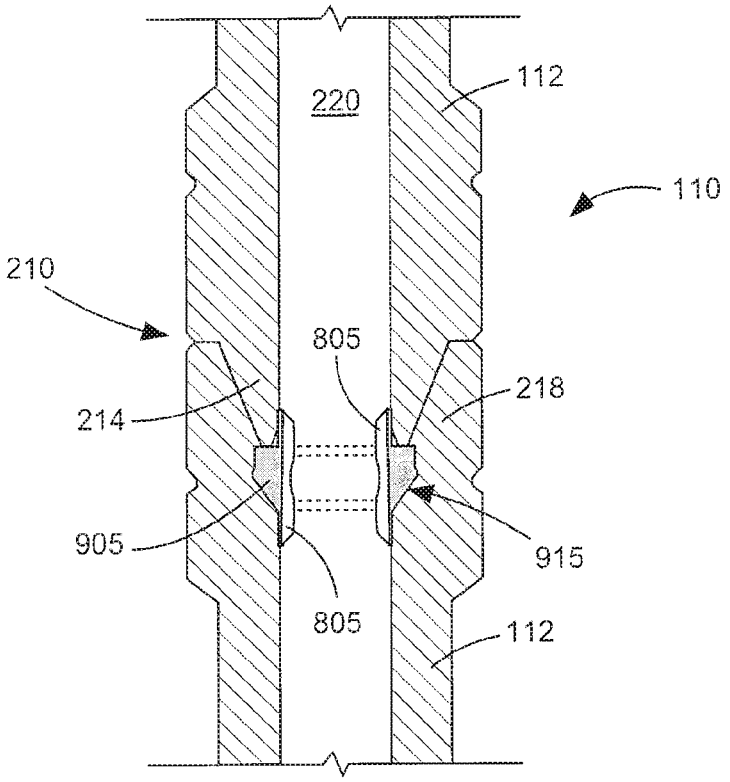
FIG. 9 depicts a cross-sectional view of a pipe joint in a drill pipe in accordance with another example embodiment.

Some embodiments may comprise electrical connectors 805 that are fastened to or integrated with pipe sections 112, so that end-to-end connection of neighboring pipe sections 112 automatically places adjacent electrodes 420 of the respective pipe sections 112 in electrical connection via the connectors 805. FIG. 9 shows a schematic illustration of such an example embodiment. In the drill pipe 110 of FIG. 9, a pair of connectors 805 are preinstalled on the threaded box formation 218 of one of the pipe sections 112, being in electrical contact with the electrode 420 (not shown in FIG. 9) of that pipe section 112. Distal ends of the electrical connectors 805 stand clear of the threaded socket of the box formation 218, so that the threaded pin formation 214 of an adjacent pipe section 112 may be inserted between the connector 805 and the socket. When the pin formation 214 is screwed into engagement with the box formation 218, the electrical connectors 805 bear against the electrodes 420 at the pin formation 214, providing a structural electrical connection between conductor segments 320 (not shown in FIG. 9) of the connected pipe sections 112.

The joint 210 of FIG. 9 further comprises an insulating ring 905 located in an inner recess or shoulder 915 in the box and 218, so that the tip of the pin end 214 likely compresses the insulating ring 905 to help reduce leakage current to the drill pipe 110. In other examples, rubber grommet-like parts could be provided in the box end of regular drill pipe connections to facilitate a similar effect. As discussed above, it is desirable to limit the amount of exposed drill pipe metal to the drilling fluid 220. The smaller such exposed surface areas are, smaller the shunt losses will be, as represented by the $R_P$ resistors in the above-discussed network models.

A disadvantage of installing the connector 805 on the box end 218 is that pin ends of pipe sections 112 may suffer more abuse on the drill floor. In embodiments where a coupler is installed on the pin end 214, protruding elements of the pin formation 214 are constructed to be robust enough to withstand such abuse. Construction of the pipe sections 112 to provide tool joints 210 such as those illustrated in FIG. 9 has the advantage that it maintains electrical contact under most drilling conditions. Is also easy to install or remove at the rig for repair and does not interfere with weekly or operations. The electrical connection can cope with reasonable tolerance differences in box and pin connections and machining of recuts can therefore be done in most locations. The joint 210 is expected to be able to withstand effects of erosion during a round and may be able to handle over 5000 hours of circulating time before needing to be replaced. Attachment of the connector 805 is such that it cannot break down and fall down the drill pipe 110, and such that it is unaffected by various forms of pipe dope including pipe dope containing metal such as zinc or copper. The joint 210 further allows normal operations to proceed, and may be configured such that connection does not require excessive care by the rig crew to stab the connector or rack back the pipe.

In yet further embodiments, the drill pipe 110 may be customized to have the electrical jumper or connector 805 recessed from fluid flow in the interior passage 128, thereby advantageously to limit the impingement on the diameter of the interior passage 128. In embodiments that include less reliable electrical joint connectors, the system may be designed based on an assumption that at least some of the connectors will lose connection from time to time.

Coating Methods

Coatings to provide the dielectric insulator 310 and/or the conductor segments 320 may range from several types including simple rust or other chemical conditioning like nitriding, non-conductive ceramics, thermal set plastics, PEEK (PolyEther Ether-Ketone), etc. In embodiments where only an insulating layer is used (to provide a dielectric insulator 310), and the drilling fluid 220 itself is the primary inner conductor, the dielectric layer should be thick enough to withstand erosion over the operational lifetime desired. Generally, the coating thickness of the dielectric insulator 310 will be driven more by erosion life requirements than by dielectric break-down voltage requirements, as even a very thin layer should provide adequate dielectric thickness.

Such coating operations in accordance with one example embodiment may comprise first roughening the internal cylindrical surface of the drill pipe 110 with steel grit or similar material to ensure that it is clean. One could opt to clean the surface from contamination of the grit with glass bead blasting afterwards. Next a coating of 0.001-0.003 thick NiCr bond coat (see for example the bond coat 410 in FIG. 4B) may be applied with a plasma spray or any other suitable means. Finally, a ceramic coating like Norton #252 Zirconium Oxide (perhaps with 5% CoO) may be plasma sprayed onto the bond coat. The thickness can vary depending upon the erosion resistance life desired. Such a ceramic coating may have a thickness of 0.01" to 0.2", but thicker coats may be used. If thicker coatings are desired, alternative materials that are more flexible may be employed to avoid cracking due to cyclical bending.

In embodiments that include a segmented conductor 230 provided by respective conductor segments 320, an inner conductive layer may be sprayed over the ceramic layer again with the same NiCr coating. The thickness of the conductive layer, however, may advantageously be great enough to reduce the series resistance along the pipe section 112 to significantly less than 1 ohm. Optimal thickness may be determined by experimentation. In such cases, the NiCr coating may serve both as part of the inner conductor 230 and as an erosion resistant layer. Other materials may also be sprayed in this manner, such as for example carbide. Use of a spray material that is rust resistant or that can be easily polished between jobs may be beneficial.

In embodiments where of the conductor segment 320 covers only a portion of the inner cylindrical surface of the drill pipe 110, such as the example embodiment described with reference to FIG. 4A above, the circumference of the interior passage 128 may be masked, so that only a strip 430 of coating is laid down, to reduce capacitance. Alternately, the entire circumference may be sprayed and may thereafter be machined or ground off in unwanted areas. Such configurations may increase the upper end of the available bandwidth on the transmission line 200 by reducing the system capacitance. The capacitance acts as a low pass filter which limits the available bandwidth by attenuating higher frequencies and reducing the stored capacitive energy capable of being carried by the drill pipe 110.

Further, if the thickness of the insulating layer providing the dielectric insulator 310 is increased along the length of the strip 430, then the capacitance is further reduced and bandwidth is further increased.

To enhance conductance at the electrodes, the full circumference of drill pipe's internal diameter may be coated over an interval of several inches. Such circumferential coating may be selected to be large enough to allow for adequate conductivity through the worst case mud for which the drill pipe 110 is intended. As mentioned previously, a final protection layer 810 may be provided over the majority of the pipe section length, to protect the conductive layer from erosion, while exposing the electrodes 420.

In some embodiments, the electrodes 420 comprise only an exposed end of the strip 430, instead of circumferential bands on each end. However, such a configuration may require more surface area of the strip 430 to be exposed, to effect good conductance into and out of the drilling fluid 220 to jump gap 305 at the tool joint 210.

Embodiments that utilize strips 430 may facilitate multi-conductor paths, but misalignment of such strips 430 may be caused by the rotary connection at each joint 210, thereby greatly complicating propagation of signals through the drilling fluid 220. If such an approach is desired, an inner conductive coupling or connector may be provided for the multiple paths across the tool joint 210. Multiple layering and positional banding, with a rotary connector plug may also be employed.

Exposure of uncovered conductor segments 320 to the drilling fluid 220 in the interior passage 128 may in some embodiments facilitate an increase in the overall bulk conductivity of the internal conductive path 208. In instances where erosion is not an issue, it may be useful to leave the conductive layer that provides the conductor segment 320 fully exposed to the drilling fluid 220, to boost the overall conductance of the internal conductive path 208.

The electrodes 420 may be made slightly bumpy or dimpled to create more surface area and thereby lower contact resistance between the drilling fluid 220 and the conductive layer of the conductor 230 at that point, to encourage better admittance of the signal through the inner electrical gap 305. Dimpling may be useful in instances where the conductive layer is thick enough to allow for it, as dimpling also improves fluid flow and reduces erosion. Yet more could be done to increase available surface area and reduce contact resistance with the drilling fluid 220, such as incorporating screens, meshes and other surface area increasing devices.

To reduce stored energy between the conductive layer that provides the conductor segment 320 and the drill pipe 110 when the pipe is not in use, a resistive connection may be provided to bleed off any stored charge over a few minutes based upon the capacitance of the two conductive layers.

There are numerous layering techniques known to those skilled in the art that may be employed. For example, the conductive layer of the conductor segment 320 may be made of multiple conductive materials to enhance strength and corrosion resistance. For example areas, exposed to mud could have a gold layering on top of the conductive layer, to avoid corrosion. In other cases the layer that provides the dielectric insulator 310 may also be a suitable binder to the internal diameter of the drill pipe 110.

Layering of various materials onto metal and subsequent layers can be achieved through several deposition techniques. A high velocity oxygen fuel (HVOF) type spray technique over plasma spraying due to the lower operational temperatures may be useful; a centralized conical custom spray nozzle might be used to facilitate the spraying over a the length of a pipe section 112. Other deposition techniques such as plasma and thermal sprays exist and could be adapted to this application by those of ordinary skill in the art.

Example Embodiments with Preformed Liners

In some alternative embodiments, drill pipe 110 may be provided with the segmented structural conductor 230 and the dielectric insulator 310 by permanently fixing a cylindrical liner coaxially to the inner surface of the drill pipe 110. Such liners may provide respective conductor segments 320, segments of the dielectric insulator 310, or both. Some methods for permanently attaching such liners to the drill pipe 110 may include hydro-forming, swaging, injection molding.

Hydro-forming or swaging a pre-made malleable liner may be particularly advantageous, as this allows a conductive layer forming part of the liner (or indeed the whole of the liner) to have a greater thickness and therefore to be less prone to wearing out over the life of the pipe section 112. Provision of a liner may thus be a cheaper and faster alternative to coating techniques discussed herein, and may additionally be more reliable. A further advantage of the liner attached by hydro-forming that the liner is not elongated in the process, and can be molded more accurately to the shape of the pipe section's radially inner surface. This is particularly the case when there are undercuts that could present problems at high down hole pressures owing to substantially cavities between the liner and the drill pipe 110. Similar to the example embodiment discussed with reference to FIGS. 6 and 7 in analyzing data transmission mechanics, one embodiment of a permanently affixed liner comprises a rubber-coated metal tube, which is a suitable combination to expand radially outward onto the inner surface of the drill pipe 110 by hydro-forming. The radially inner surface of the pipe section 112 may in such instances be prepared in a manner similar to a mud motor stator tube with a specified roughness, with shot peening or sand blasting, combined with coating of an adhesive onto the metal inner surface of the pipe section's bore and/or onto the radially outer surface of the rubber tube, prior to the hydro-forming operation. Once formed, the adhesive may be cured through heating or chemical delayed reactance.

Figure 10A:
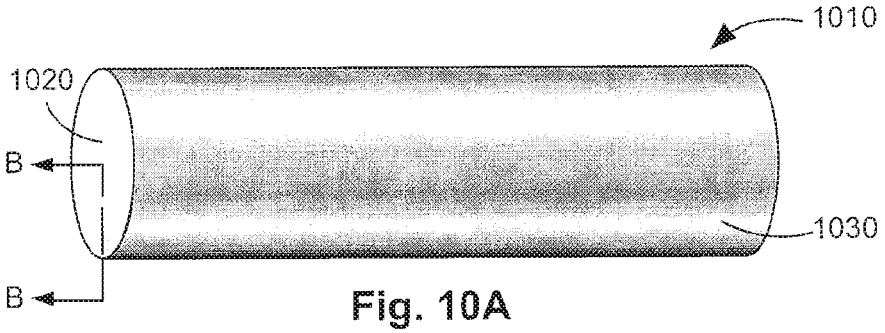
FIG. 10A depicts a schematic three-dimensional view of a liner for insertion in a drill pipe in accordance with an example embodiment.
Figure 10B:
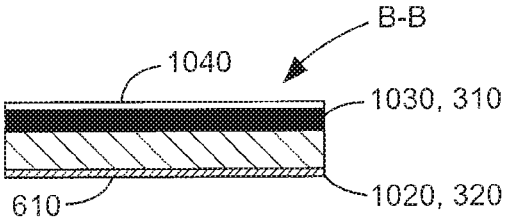
FIG. 10B depicts a sectional view of laminate material providing a cylindrical wall of the liner of FIG. 10A.

FIGS. 10A and 10B show an example embodiment of a blank for a liner 1010 that may be attached by a hydro-forming process as discussed above, although the liner 1010 may readily be adapted for swaging in a manner similar to that used in expandable tubular technologies. The liner 1010 comprises a conductor segment 320 (see FIG. 10B) provided by a metal jacket or tube 1020 and a dielectric insulator 310 provided by a coaxial rubber tube 1030. The liner 1010 may in some instances overshoot the respective pipe section 112 on one or both ends, and some clean-up machining to cut off the excess material may be performed to control variable length issues in the pipe section 112.

The above-discussed method of manufacture may be advantageous in that it is relatively inexpensive and promotes durability of the pipe section 112. Once the liner 1010 is attached by hydro-forming, additional coating(s) can be done to either re-dress the pipe section 112 or improve upon what is already in place. The liner 1010 may include an adhesive coating 1040 on the outside of the rubber tube 1030. In many instances, the adhesive coating 1040 may be unnecessary and may be omitted, as residual hoop stress applied by the primary conductor tube 1020 may be sufficient to prevent the liner 1010 from axial movement relative to the drill pipe 110. Also not shown in FIG. 10B, an adhesive layer may in some instances be provided between the conductor tube 1020 and the rubber tube 1030.

As is the case with previously discussed example embodiments, an inner erosion protection layer 810 (see FIG. 8), such as a carbide layer, may be provided on part of the radially inner surface of the conductor tube 1020. The protection layer 810 may additionally be corrosive resistant.

In yet further embodiments, a prefabricated the liner such as that described with reference to FIGS. 10A-10B may be provided without an outer elastomeric or dielectric tube 1030. Instead, elastomers or other moldable non-conductive compounds like high temperature plastics may be injection-molded in a tubular space between the radially outer surface of the primary conductor tube 1020 outside diameter (OD) and the pipe section 112. In such a case, the adhesive layer 1040 may be applied to the inner surface of the of the drill pipe 110 and to the outer diameter of the primary conductive tube 1020. Thereafter, the liner may be inserted into the pipe section 112 and centralized with non-conductive centralizers, after which rubber is injected. Other mechanical means may be used, if necessary, to hold the liner. Such mechanical locators may include variations in the outer diameter of the conductor tube 1020 and/or in the inner diameter of the drill pipe 110. Such a molding process may thus be molding process be similar to standard methods for forming mud motor stators. Other methods used to aid in injection molding may be employed and are well known by those of ordinary skill in the art. After injection, the injected rubber maybe vulcanized through a baking procedure.

It may be useful in some instances to convert conventional drill pipe on-site at a drilling installation in order to provide the drill string with an internal conductive path 208, to permit use the above-described data signal transmission techniques in the drill string. Liners analogous to that described above with reference to FIGS. 10A-10B may be used for such conversions and may in some instances be removably and replaceably inserted in respective pipe sections 112. An advantage of preformed liners that form part of customized drill pipe, when compared to converted drill pipe, is that it may consume less of the cross sectional area of the interior passage 128, therefore providing a large fluid passage of a. Increased circulating pressure and higher flow velocities resulting from a reduced fluid conduit may in some instances, such as shallow to medium wells, not be a significant factor.

Some embodiments may provide liners that may be variable in length, for example by telescopic extension and retraction, for example to adjust the length of liners which are to be installed on the drill floor just before making up joints 210, in order to accommodate variations in pipe section length. For similar reasons, other embodiments may provide liners similar to that of FIG. 10, but including an overlap feature so that adjacent ends of neighboring liners may overlap to promote electric insulation of the drill pipe 110 at the joints 210.

Example Embodiments for Continuous Tubing

Some embodiments provide for use of the above-described data signal transmission method in a continuous string of tubing, such as coil tubing. A continuous thin strip conductor (similar in function to the segment conductor 230 described with FIGS. 1-5 above) that is attached to the tubular wall of the tubing string, while being insulated therefrom, may provide an internal conductive path to allow for use of the tubing string as a two-path transmission line similar to the transmission line 200 described above. In other embodiments, coil tubing may be provided with a dielectric insulator layer on its radially inner surface, so that a column of drilling fluid in the tubing may be used as primary conductor of an internal conductive path of a two-wire transmission line whose other conductive path is provided by the conductive material of the continuous tubing.

An advantage of such a strip conductor embodiment over, for example, E-Line coil tubing, is a significantly smaller loss in circulating capacity when compared to an insulated conductor extending centrally along the fluid conduit of E-Line coil tubing. Not only is the cross-sectional area of the fluid conduit consumed by the internal conductor smaller, but flow velocity is lowest along the radially inner wall of the tubing, so drag on the fluid is reduced relative to E-Line coil tubing. Since the internal conductor of such coil tubing string is continuous, it is not segmented and does not have to jump tool joints other than at the bottom and the top of the string. Losses may thus be low. Use of an internal conductor in the form of a thin long strip greatly reduces capacitance compared to coating the entire inner cylindrical surface of the tubing string, and therefore increases bandwidth. In applications where bandwidth is not a concern, the entire inner surface of the oil tubing string may be coated with conductive material, to provide a tubular internal conductor extending along the length of the tubing string.

Coil tubing that incorporates an internal conductor attached to the inner surface of the tubing, such as that described above, may be manufactured using a high velocity oxygen fuel (HVOF) or plasma sprayer pulled or driven inside the tubing string over the length of the tubing string.

Figure 11A:
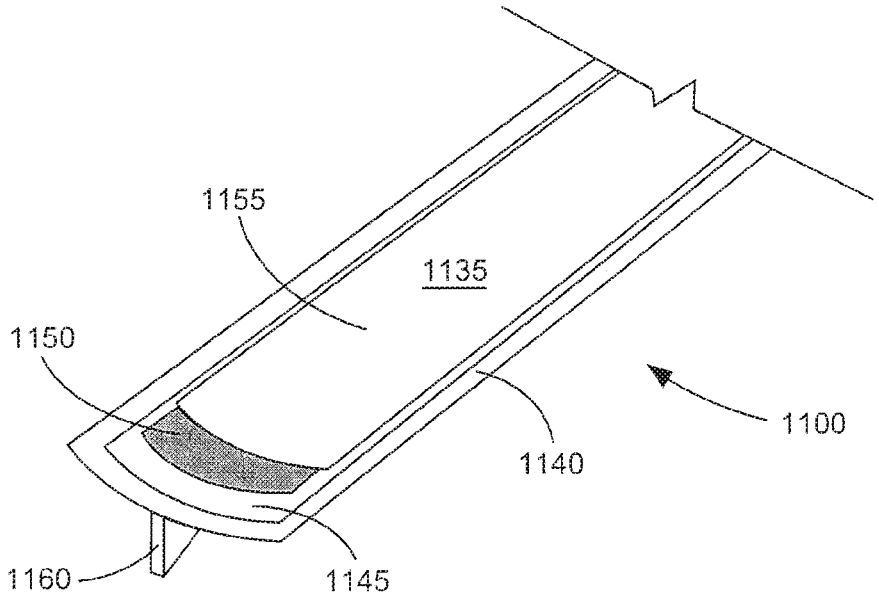
FIG. 11A depicts a schematic three-dimensional view, from below, of an inlay for use in the manufacture of coil tubing for a drill string.

An example method of manufacturing tubing string with an integral elongated strip conductor fast with the string's tubular wall will now be described with reference to FIGS. 11A-11B.

The method comprises providing an elongated strip or inlay 1100 that is integrated with coil tubing 1120 as the tubing 1120 is rolled from a sheet 1130 into a tubular and is welded together. The welded inlay 1100 is pre-made with the appropriate layering, which can partly be seen in the partial cut-away view of FIG. 11A.

FIG. 11 A. provides a view of the radially inner surface 1135 of the inlay 1100, which faces of the fluid conduit, in use. In this embodiment, the inlay 1100 comprises a part-cylindrical metal base 1140 on which a bonding layer (not shown) is first laid down. Thereafter, a dielectric layer 1145 is provided on the bonding layer. A conductive layer 1150 is then provided on the dielectric layer 1145, to form an internal conductor for the tubing 1120. The conductive layer 1150 is in this example covered with a protective/insulating layer 1155, which may be omitted in other embodiments.

Figure 11B:
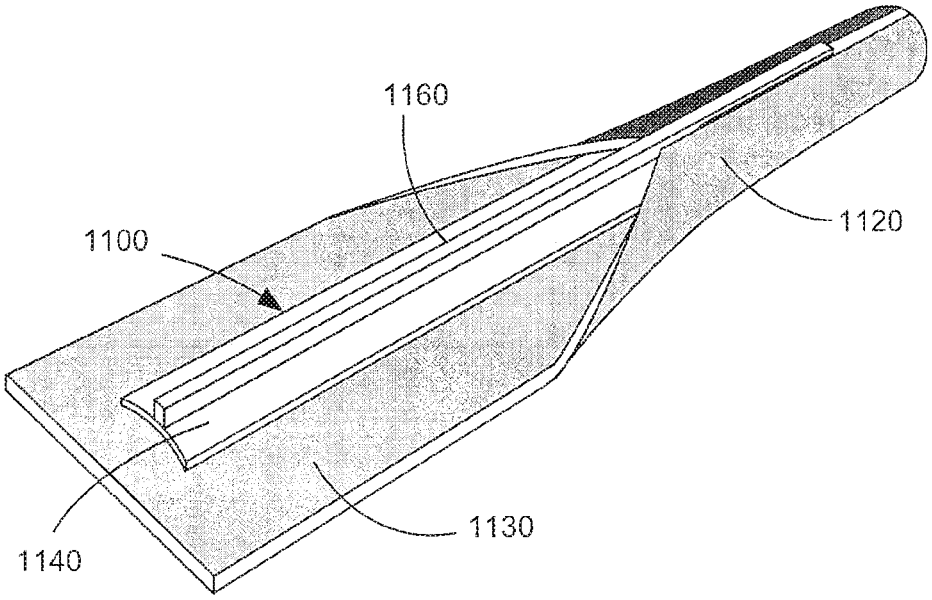
FIG. 11B depicts a schematic three-dimensional view, from above, of a method of manufacturing coil tubing using the inlay of FIG. 11A.

The inlay 1100 has a central radially outwardly projecting spine 1160 in the form of a metal bar that is pinched between edges of the metal sheet 1130 as the sheet 1130 is rolled, to hold the inlay 1100 in place (see FIG. 11B). The inlay 1100 and the rolled tubing 1120 are then welded together and ground smooth, allowing for a continuous operation. Coil tubing is often made by rolling sheet metal. The example embodiment of FIG. 11 conveniently adds a single extra component (namely the inlay 1100) in the welding process. The coil tubing 1120 may replace E-line tubing in some applications, since electrical connections to the opposite ends of the tubing are used.

The part cylindrical plate-like base 1140, forming wings on either side of the welded rectangular bar that provides the spine 1160 may be used in applications where more surface area for the conductor path provided by the conductive layer 1150 is desired. In other applications, the area provided on the radially inner surface of the tubing 1120 by the rectangular bar or spine 1160 itself may be sufficient for the current-carrying needs of the signal, thereby eliminating use of the wings. The rectangular bar 1160 may have other shapes and may have inlay grooves in its radially inner face, to receive the various insulators and conductors which may in some embodiments include a wire. Alternative insulators like ceramic may be used as protection from the heat in the welding process.

Yet further embodiments may be employed in applications where flow rate is maximized with available diameters, in which instances provision of a dielectrically insulated liner may be less practicable. U.S. Pat. No. 6,712,150 (incorporated herein by reference in its entirety), describes a system which has inner and outer tubing strings to facilitate vacuuming up of sand and other material in, for example, sanded-in wells, as is known to those of ordinary skill in the art. Such a system could be adapted to the telemetry methods described herein. The adaptation may comprise sealing the electric leak path between the tubing of the two coaxial coils sufficiently with a suitable dielectric, so that the tubing of the inner coil can serve as an internal conductive path 208 and the tubing of the outer coil can serve as an outer conductive path 204 in a two-path transmission line that functions similar to the example transmission line 200 examined above. A non-conductive or dielectric coating may, for example, be provided on the radially outer surface of the inner tubing.

Alternative Treatments of Pipe Bores

Various further configurations for the cylindrical inner surface or bore of the drill pipe 110 may be employed in addition to those exemplified above. Some embodiments may, for example, operate without any coating for at least part of the drill string 108. Although this may result in high shunt losses, it may occur for short intervals, for example to "sneak" a signal across gaps of a few inches. Some embodiments may also provide for a structural internal conductor along parts of the length of the drill string, but using the drilling fluid as primary internal conductor for some pipe sections or significant intervals of up to 1000 m or more.

Instead, a semi-conductive coating may be provided. A rust layer on the inner surface of the drill pipe 110 semi-conductance of drilling fluid may for example provide the internal conductive path. The inner diameter of the drill pipe 110 may in another example be chemically treated to create a resistive layer, for example with hardening processes like gas or liquid nitriding.

Another embodiment provides for coating or lining the drill pipe bore with a highly resistive dielectric layer, but without a structural conductor, so that the drilling fluid 220 provides the primary internal conductor.

Drilling Fluid Considerations

The efficacy of the transmission line 200 may benefit from fluid conditioning, to promote sufficient conductivity of the drilling fluid 220 for a desired signal-to-noise ratio to be developed, and for the shunt path to be of relatively high resistance. Signal propagation distances can thereby be increased.

There are several possible mud applications, including oil- and water-based muds. In relatively pure form, both fluids are poor conductors. Water and oil, of course, do not mix well. The means of conditioning mud to improve electrical conductivity may be different depending on the mud type.

Water-based muds can be made more conductive by adding dissolvable salts to the fluid. Once dissolved, free ions from the salts allow for greatly increased conductivity.

Since salt does not dissolve and form free ions in oil-based muds, other means may be utilized to promote electrical conductivity. Some methods may include adding metallic powder, carbon black or short carbon fibers to the mud, typically >⅛" long by 8 microns in diameter. In each case an additive may pre-coats these particles such that it improves electrical contact between particles. U.S. Pat. No. 3,406,126 (incorporated herein by reference in its entirety) describes utilization of long, thin carbon yarn fibers where the diameter to length ratios range from 640:1 to 1920:1 and the length is about ¼" to ¾" and the diameter is 10 microns, as is known to those of ordinary skill in the art. High shear mixing tears these fibers up. U.S. Pat. No. 4,228,194 (incorporated herein by reference in its entirety) improves on this by further reducing the length and diameter of the fibers, and pre-coating the fibers with silicon oil, as is known to those of ordinary skill in the art. This causes the fibers to repel resins or paints they are in, so they are attracted more to each other making the useful concentration required much lower. The silicon oil does not easily dissolve into mineral oils not based upon silicon, such as hydrocarbon based oils.

Yet further, U.S. Pat. No. 6,770,603 B1 (incorporated herein by reference in its entirety) describes the use of carbon black and surfactants to boost the conductivity of oil-based mud, as is known to those of ordinary skill in the art. Advantages of using black carbon include its ease of mixing and non-fiber nature, as fibers could be damaged in the drill bit or pumps, for example. Similar substances such as graphite powder may also be used.

Conduction of a direct current through an oil-based mud may be highly resistive. Its fluid electrical admittance is thus a much lower than its electrical susceptance. Oil-based mud may thus have a pass band that does not include baseband content, whereas water based mud may conduct direct current and act more like a low pass filter.

Some embodiments may include, during certain operations (like pumping of a LCM pill, or viscous sweeps, etc.), performing pill pre-conditioning to promote conductivity and reduce the impact of these types of operations. Such pills can be pre-mixed in sack or other forms to accommodate the rig operations without having to make measurements and adjustments on the fly. Since wet cement is a conductor, the described signal transmission methods may be employed during cementing operations.

Signal Processing Considerations

Some embodiments utilize a signal that sends electrons only onto the internal conductive path 208 (see FIG. 2). This is a form of cathodic protection of the internal conductive path 208, so that iron of the drill pipe 110 is used as a sacrificial anode. In this manner, signals are bias-shifted to the negative polarity on the internal conductive path 208. This may be useful in instances where coating corrosion is problematic.

Signal reception and processing may be performed differently from conventional EM Measurement While Drilling (MWD), in which one or more conductor rods are placed into the earth well away from the wellhead. Instead, in some embodiments described herein, these operations occur on the drill floor, comparing the differential voltage across the internal conductive path 208 of the drill pipe 110 and the drill pipe 110 itself. In conventional methods, the current traveling in the drill pipe could easily jump through surface conductors/casing and thus be grounded with any contacting metal. Some example embodiments may include connecting electrically directly to the drill pipe 110 to avoid any variations in conductance created through movement of the drill pipe 110. One receiver wire may for example simply be connected to the rig ground, and the other receiver wire may be connected to the segmented conductor 230 of the drill pipe 110, or to an insertable conductor in the drilling fluid 220 inside a sub, such as the uphole transceiver sub 127.

Such a signal conductor in the mud or drilling fluid 220 could also be provided by a sub with a fluid-exposed conductor similar to the previously described conductor segments 320. In other embodiments, a receiving conductor such as a wire path may run to a swivel where the signal hops across a slip ring to a non-rotating cable that leads to a surface transceiver. Likewise, a ground conductor may be connected to the drill pipe 110 and may also run through the swivel, to ensure a clean path for both polarities of the transmission line 200. This provides two signal conductors.

In yet further embodiments, the signal may be received by a surface transceiver which is in a sub on surface that rotates with the drill string, similar to the uphole transceiver sub 127 of FIG. 1. This sub may communicate with a stationary receiver through any one of a variety of means, such as a slip ring, acoustics through the air, stress waves in the rig iron, light, radio, or other means. Inductive coupling between a stationary and a rotating coil may also be used, with a pre-amplifier to boost the incoming signal from downhole.

Some embodiments include the use of repeater or sensor nodes throughout the drill string 108. Various signal modulation modes may be used. A signal modulation scheme that is not signal amplitude dependent, such as phase modulation or frequency modulation methods, may be employed advantageously during, for example, connection events or nitrogen pumping.

Therefore, numerous embodiments may be realized. These include the following:

One embodiment provides a system comprising a drill string that extends along at least part of a wellbore, the drill string comprising drill pipe having a tubular wall that is of electrically conductive material and that defines an interior passage extending along the drill string to convey drilling fluid, the drill string providing a signal transmission line that comprises an outer conductive path formed by the tubular wall of the drill pipe, and an internal conductive path extending along the interior passage, the internal conductive path being substantially electrically insulated from the outer conductive path; and a transmitter coupled to the transmission line to transmit a data signal along the transmission line.

At least part of the internal conductive path may comprise the drilling fluid in the interior passage.

The drill string may include a dielectric insulator located radially between the interior passage and the tubular wall of the drill pipe, to provide electrical insulation between the internal conductive path and the outer conductive path.

The internal conductive path may comprise a structural conductor that extends lengthwise along the drill string and is attached to the tubular wall of the drill pipe such that the structural conductor is located at or adjacent a radially outer boundary of the interior passage, when the drill pipe is viewed in cross-section.

The drill pipe may be segmented, comprising a plurality of pipe sections that are connected together end-to-end in series, each pipe section including a conductor segment that is attached to the tubular wall of the pipe section and extends along a substantial portion of the length of the pipe section, the conductor segments of the plurality of pipe sections be arranged end-to-end in series, together to provide a segmented structural conductor extending along multiple pipe sections and forming part of the internal conductive path.

The segmented structural conductor may further comprise a plurality of electrical connectors at respective pipe section joints, each electrical connector providing a structural electrical connection between adjacent conductor segments of neighboring pipe sections.

At least some of the plurality of pipe sections may each have a threaded pin formation at its one end and a complementary threaded box formation at its other end, a respective electrical connector being integrated with the box formation such that connection of neighboring pipe sections by threaded engagement of their respective pin- and box formations automatically connects the conductor segments of the neighboring pipe sections through the associated electrical connector.

The segmented structural conductor may have a plurality of gaps at respective pipe section joints, at least part of each conductor segment being exposed to drilling fluid in the interior passage at the respective gaps, to propagate electrical current between adjacent conductor segments through the drilling fluid.

At least some pipe sections may each include a protection layer that covers part of the associated conductor segment to protect the covered part of the conductor segment from exposure to drilling fluid in the interior passage, the conductor segment further comprising exposed electrodes at opposite ends of the pipe section to facilitate propagation of current between adjacent electrodes through the drilling fluid.

At least some of the conductor segments may each include an electrode adjacent each end of the respective pipe section, each electrode being annular and extending circumferentially around the interior passage.

A ratio between a width dimension of one of the electrodes in the longitudinal direction of the drill string and an inner diameter of the interior passage may be about 0.3 to about 0.5, and in some embodiments may be about 0.4.

A radially inner surface of each electrode may be dimpled.

Each conductor segment may comprise a conductor strip extending lengthwise between the electrodes of the conductor segment. Each conductor segment may comprise a coated layer of conductive material.

At least some of the conductor segments may each be attached to a radially inner surface of a tubular liner of dielectric material that lines the associated pipe section, the liner being removably and replaceably connected to the tubular wall of the pipe section.

The transmitter may be located in the drill string between a bottom hole assembly and a receiver above the transmitter, the system further comprising an electrical choke, an electrical short, or an electrical block located in the drill string below the transmitter to inhibit downhole propagation of the data signal.

Yet another embodiment provides a method for transmitting data in a drilling installation that comprises a drill string extending along at least part of a wellbore, the method comprising transmitting a data signal along a transmission line extending lengthwise along the drill string, the transmission line comprising an outer conductive path provided by a tubular wall of a drill pipe that extends along the drill string; and an internal conductive path extending along an interior passage that is bounded by a radially inner cylindrical surface of the drill pipe and along which drilling fluid is conveyed, the inner conductive path being substantially insulated from the outer conductive path.

The internal conductive path may comprise drilling fluid in the drill pipe, transmission of the data signal comprising propagating signal current through the drilling fluid as primary conductor of the internal conductive path.

Transmitting the data signal along the transmission line may include propagating signal current in the internal conductive path through a structural conductor that extends lengthwise along the drill string and is connected to the tubular wall of the drill pipe.

The drill pipe may be formed by connecting together a plurality of pipe sections, transmission of the data signal along the transmission line including propagating signal current along a segmented structural conductor in the internal conductive path, the segmented structural conductor comprising a plurality of conductor segments that are attached to respective pipe sections and extend in series along at least a part of the length of the drill string.

In such a case, transmitting the data signal along the transmission line may include propagating signal current between neighboring conductor segments in the internal conductive path through respective structural electrical connectors that bridge associated pipe section joints.

Instead, or in addition, transmitting the data signal along the transmission line includes propagating signal current between neighboring conductor segments in the internal conductive path through the drilling fluid, to bridge electrical gaps that separate neighboring conductor segments.

Propagating the signal current through the drilling fluid may comprise exposing only electrodes of the conductor segments to the drilling fluid, the electrodes being located adjacent opposite ends of the respective pipe sections, and portions of the conductor segments between the electrodes being covered from exposure to the drilling fluid. Each conductor segment may comprise a coated layer of conductive material.

The method may further comprise the operation of attaching tubular liners of dielectric material to respective pipe sections, the conductor segments being carried on a radially inner surface of the respective tubular liners.

Another embodiment provides segmented drill pipe that, when coupled together as two or more pipe sections, provides an outer conductive path and an inner conductive path to form a hybrid signal propagation path for an electrical signal, the outer conductive path comprising conductive material of a tubular wall of the drill pipe, and the inner conductive path comprising a combination of, on the one hand, structural conductor elements extending lengthwise along respective pipe sections and, on the other hand, drilling fluid in a fluid conduit formed by the coupled pipe sections.

The structural conductor element of a respective pipe section may comprise at least one of a conductive coating, a single solid conductor, or a conductive liner disposed lengthwise along the interior of the pipe section.

The segmented drill pipe may include dielectric insulator between the tubular wall of the drill pipe and the associated structural conductor.

The segmented drill pipe may further comprise an electrical connector fastened to the pipe section to provide an electrical connection between structural conductor elements of neighboring pipe sections when the pipe sections are coupled, to bridge an electrical gap between the structural conductor elements at a pipe section joint.

The electrical connector of the pipe section may be located at a threaded box end for engagement with a complimentary threaded pin and of a neighboring pipe section.

The segmented drill pipe may further comprise a protection layer that covers part of the structural conductor elements to protect the covered part of the structural conductor element from exposure to the drilling fluid, the structural conductor element further comprising exposed electrodes at opposite ends of the pipe section to facilitate propagation of current between adjacent electrodes through the drilling fluid. Each electrode may be annular, extending circumferentially around the interior of the drill pipe. The structural conductor element may comprise a conductive coating that includes a narrow conductor strip extending lengthwise between the annular electrodes provided by the conductive coating.

Thus, example methods and systems for data transmission in drilling operation environments, and example methods of manufacture for drill string equipment have been described. It will be evident that various modifications and changes may be made to these embodiments without departing from the broader spirit and scope of method and/or system. Accordingly, the specification and drawings are to be regarded in an illustrative rather than a restrictive sense.

In the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment.

What is claimed is:

1. A system for transmitting data in an installation, the system comprising:

a coiled tubing string which extends along at least part of a wellbore, the coiled tubing string having a tubular wall that is of electrically conductive material and that defines an interior passage extending along the coiled tubing string to convey drilling fluid, the coiled tubing string providing a signal transmission line that comprises:

an inner conductive path extending along the interior passage, the inner conductive path comprising a continuous strip conductor on an inner surface of the tubular wall, wherein the inner conductive path is electrically insulated from the tubular wall; and an outer conductive path formed by the coiled tubing string, the outer conductive path being electrically insulated from the inner conductive path, wherein the continuous strip conductor comprises:

a base having an inner and outer surface, the inner surface facing the interior passage of the coiled tubing string and the outer surface facing an exterior of the coiled tubing string;

a spine projecting outwardly from the outer surface of the base;

a dielectric layer attached to the inner surface of the base; and a conductive layer attached to the dielectric layer; and a transmitter coupled to the transmission line to transmit a data signal along the transmission line.

2. The system of claim 1, wherein at least part of the inner conductive path comprises the drilling fluid in the interior passage.

3. The system of claim 1, wherein the coiled tubing string includes a dielectric insulator located radially between the inner conductive path and the tubular wall to provide electrical insulation between the internal conductive path and the outer conductive path.

4. The system of claim 1, wherein the drilling fluid is a non-conductive fluid with a conductive material added to the non-conductive fluid to enable passage of electrical current through the drilling fluid.

5. The system of claim 4, wherein the conductive material is selected from a group consisting of metallic powder, carbon black, and short carbon fibers.

6. The system of claim 4, wherein the conductive material includes fibers with each fiber being greater than 0.125 inches long and greater than 8 microns in diameter.

7. The system of claim 4, wherein the conductive material includes fibers, and wherein the fibers are coated with material that improves electrical contact between the fibers.

8. The system of claim 1, further comprising an insulating layer positioned over the conductive layer.

9. A method for transmitting data in an installation that comprises a coiled tubing string extending along at least part of a wellbore, the coiled tubing string including a tubular wall, the method comprising:

transmitting a data signal along a transmission line extending lengthwise along the coiled tubing string, the transmission line comprising:

an inner conductive path extending along an interior passage of the coiled tubing string, the inner conductive path comprising a continuous strip conductor on an inner surface of the tubular wall, wherein the strip conductor is electrically insulated from the tubular wall; and an outer conductive path formed by the coiled tubing string, the outer conductive path being electrically insulated from the inner conductive path, wherein the continuous strip conductor comprises:

a base having an inner and outer surface, the inner surface facing the interior passage of the coiled tubing string and the outer surface facing an exterior of the coiled tubing string;

a spine projecting outwardly from the outer surface of the base;

a dielectric layer attached to the inner surface of the base; and a conductive layer attached to the dielectric layer.

10. The method of claim 9, wherein the internal conductive path includes drilling fluid in the coiled tubing string, transmission of the data signal comprising propagating signal current through the drilling fluid as a primary conductor of the internal conductive path.

11. The method of claim 10, wherein the drilling fluid is a non-conductive fluid with a conductive material added to the non-conductive fluid to enable passage of electrical current through the drilling fluid.

12. The method of claim 11, wherein the conductive material includes fibers, and wherein the fibers are coated with material that improves electrical contact between the fibers.

13. The method of claim 9, wherein the coiled tubing string includes a dielectric insulator located radially between the inner conductive path and the tubular wall to provide electrical insulation between the internal conductive path and the outer conductive path.

14. The method of claim 9, further comprising an insulating layer positioned over the conductive layer.

15. A method of manufacturing a system for transmitting data in an installation, the method comprising:

providing a coiled tubing string which extends along at least part of a wellbore, the coiled tubing string having a tubular wall that is of electrically conductive material and defines an interior passage extending along the coiled tubing string to convey drilling fluid, the coiled tubing string providing a signal transmission line;

providing an inner conductive path extending along the interior passage, the inner conductive path comprising a continuous strip conductor on an inner surface of the tubular wall, wherein the inner conductive path is electrically insulated from the tubular wall;

providing an outer conductive path formed by the coiled tubing string, the outer conductive path being electrically insulated from the inner conductive path, wherein the continuous strip conductor is provided with:

a base having an inner and outer surface, the inner surface facing the interior passage of the coiled tubing string and the outer surface facing an exterior of the coiled tubing string;

a spine projecting outwardly from the outer surface of the base;

a dielectric layer attached to the inner surface of the base; and a conductive layer attached to the dielectric layer; and providing a transmitter coupled to the transmission line to transmit a data signal along the transmission line.

16. The method of claim 15, wherein providing the inner conductive path further comprises providing the continuous strip conductor as a conductive inlay integrated with coiled tubing as the coiled tubing is rolled from a sheet, wherein the continuous strip conductor and rolled coiled tubing are welded together to form the coiled tubing string.

17. The method of claim 15, wherein at least part of the inner conductive path comprises the drilling fluid in the interior passage.

18. The method of claim 15, wherein the coiled tubing string is provided with a dielectric insulator located radially between the inner conductive path and the tubular wall to provide electrical insulation between the internal conductive path and the outer conductive path.

19. The method of claim 15, wherein the drilling fluid is a non-conductive fluid with a conductive material added to the non-conductive fluid to enable passage of electrical current through the drilling fluid.

20. The method of claim 19, wherein the conductive material is selected from a group consisting of metallic powder, carbon black, and short carbon fibers.

21. The method of claim 19, wherein the conductive material includes fibers with each fiber being greater than 0.125 inches long and greater than 8 microns in diameter.

22. The method of claim 19, wherein the conductive material includes fibers, and wherein the fibers are coated with material that improves electrical contact between the fibers.

23. The method of claim 15, wherein an insulating layer is positioned over the conductive layer.

24. The method of claim 15, wherein the system is manufactured by:

rolling coiled tubing from a sheet of rolled coiled tubing;

positioning the continuous strip conductor inside the rolled coiled tubing such that the spine is pinched between edges of the rolled coiled tubing; and welding the continuous strip conductor and rolled coiled tubing together.

* * * * *